US012571577B2

(12) United States Patent
Lee et al.

(10) Patent No.: US 12,571,577 B2
(45) Date of Patent: Mar. 10, 2026

(54) REFRIGERATOR

(71) Applicant: MUDATECH KOREA CO., LTD., Seoul (KR)

(72) Inventors: Myung Ryul Lee, Yongin-si (KR); Omid Nematollahi, Changwon-si (KR); Mehdi Rasti, Gunpo-si (KR); Seyed Mohammad Reza Mostafaei, Changwon-si (KR); Amir Hossein Kholghi, Changwon-si (KR); Fatemeh Ghadiri Modarres, Changwon-si (KR); Gholamhosein Kasaei, Izmir (TR)

(73) Assignee: MUDATECH KOREA CO., LTD., Seoul (KR)

( * ) Notice: Subject to any disclaimer, the term of this patent is extended or adjusted under 35 U.S.C. 154(b) by 95 days.

(21) Appl. No.: 18/359,908

(22) Filed: Jul. 27, 2023

(65) Prior Publication Data

US 2024/0044567 A1 Feb. 8, 2024

(30) Foreign Application Priority Data

Aug. 4, 2022 (KR) ..... 10-2022-0097587

(51) Int. Cl.
*F25D 17/06* (2006.01)
*F25D 23/04* (2006.01)

(52) U.S. Cl.
CPC ..... *F25D 17/065* (2013.01); *F25D 23/04* (2013.01); *F25C 2400/10* (2013.01); *F25D 2317/061* (2013.01); *F25D 2317/062* (2013.01); *F25D 2323/023* (2013.01)

(58) Field of Classification Search
CPC .... F25D 17/065; F25D 23/04; F25D 2400/10; F25D 2317/061; F25D 2317/062; F25D 2323/023
See application file for complete search history.

(56) References Cited

U.S. PATENT DOCUMENTS

2012/0096872 A1* 4/2012 Cheong ..... F25D 23/025 62/340
2018/0164017 A1* 6/2018 Jeong ..... F25D 23/04
2019/0024962 A1* 1/2019 Lee ..... E05D 11/00

* cited by examiner

*Primary Examiner* — Elizabeth J Martin
(74) *Attorney, Agent, or Firm* — NKL Law; Jae Youn Kim

(57) ABSTRACT

A refrigerator includes one main door that opens and closes to seal a storage compartment and that incorporates a convenience space and a dispenser, at least one sub-door coupled to the main door to selectively open and close the convenience space, and an ice-making room mounted to the main door to supply water or ice to the dispenser.

12 Claims, 18 Drawing Sheets

REFRIGERATOR

CROSS REFERENCE TO RELATED APPLICATION

The present application claims the benefit of Korean Patent Application No. 10-2022-0097587 filed in the Korean Intellectual Property Office on Aug. 4, 2022 the entire contents of which are incorporated herein by reference.

FIELD OF THE INVENTION

The present invention relates to a refrigerator.

BACKGROUND

Generally, a refrigerator is a home appliance used for keeping things cold or frozen by using a refrigeration cycle. The refrigerator includes a body in which a storage room such as a freezing room and a refrigerating room is disposed and a door located on the body to open and close the storage room.

Refrigerators are largely classified into a top mount refrigerator in which a freezing room is located at the top of a refrigerating room, a bottom freezer refrigerator in which a freezing room is located at the bottom of a refrigerating room, and a side-by-side refrigerator in which a freezing room and a refrigerating room are dividedly located on left and right sides.

Recently, the capacity of a refrigerator tends to greatly increase, door shelves and accommodation casings are provided even inside the doors to efficiently utilize convenience space in which things are accommodatedly stored, and further, an ice maker is located on the door. The ice produced from the ice maker is supplied to a consumer through a dispenser which is installed on the door.

Especially, the recent refrigerator includes main doors for opening and closing the storage room and convenience space formed as auxiliary storage rooms inside the main doors, in order to enhance energy efficiency and accessibility to refrigerated foods. Further, sub-doors are rotatably connected to the main doors to allow a user to easily access the convenience space.

However, the restriction of the main doors in size may fail to allow the convenience space, the dispenser, and the ice maker to be disposed in the main door, all together. If the ice maker and the dispenser are disposed in the main door, it is hard to supply a sufficiently large amount of ice, while the convenience space utilizable on the main doors are being ensured.

SUMMARY OF THE INVENTION

Accordingly, one or more embodiments of the invention have been made in view of the above-mentioned problems occurring in the related art, and it is an object of the present invention to provide a refrigerator that is configured to have an ice maker capable of supplying a sufficiently large amount of ice, while locating convenience space utilizable on main doors.

To accomplish the above-mentioned objects, according to an exemplary embodiment, there is provided a refrigerator including: main doors open and closed, while sealing a storage room of the refrigerator, and having convenience space and a dispenser located therein; sub-doors open and closed, while sealing the convenience space, and connected to the main doors; and an ice making room connected to the main door to supply water or ice to the dispenser.

According to an exemplary embodiment, one of the convenience space may be located at the top of the dispenser so that when the corresponding sub-door is open, the accommodation space is located at the height of a user's eyes.

According to an exemplary embodiment, the one of the convenience spaces of the main doors may include: a first cold air portion for introducing cold air thereinto from the ice making room; and a second cold air portion for emitting the cold air of the accommodation space to the storage room.

According to an exemplary embodiment, one side sub-door may include an opening for exposing the dispenser to the outside.

According to an exemplary embodiment, the ice making room may include: an ice maker for producing the ice; a cold air supply part for supplying the cold air to the ice maker; an ice bucket for keeping the cold air passing through the ice maker to a temperature below zero degree Celsius; and a cold air emission part for emitting the cold air of the ice bucket to the storage room.

According to an exemplary embodiment, the refrigerator may further include: cold air ducts for connecting an evaporator for producing the cold air supplied to the storage room to the cold air supply part; and a cold air fan located between one side cold air duct and the evaporator to introduce the cold air into one side cold air duct.

According to an exemplary embodiment, the storage room may include: a refrigerating room to which the main doors are connected; and a freezing room located at the underside of the refrigerating room to supply the cold air to the main doors.

According to an exemplary embodiment, the refrigerator may further include: cold air passages formed close to one side main door and connected to the main door to allow the freezing room to communicate with the refrigerating room; and a blowing fan located in the freezing room to supply the cold air of the freezing room to the corresponding cold air passage.

According to an exemplary embodiment, the main door may include circulating ducts connected to the cold air passages to supply and emit the cold air of the freezing room to and from the ice making room.

According to an exemplary embodiment, the cold air passages may be formed at the bottom surface of the refrigerating room.

According to an exemplary embodiment, the cold air passages may be formed at the side surface of the refrigerating room.

According to an exemplary embodiment, the ice making room may include an insulation layer connected to the corresponding accommodation space.

According to an exemplary embodiment, portions of the cold air ducts may be exposed to the storage room.

According to an exemplary embodiment, the cold air ducts may include cold air duct end portions extending therefrom to be exposed to one side of the evaporator.

According to an exemplary embodiment, the cold air fan may be disposed in the interior of the cold air end portion of one side cold air duct.

BRIEF DESCRIPTION OF THE DRAWINGS

The above and other objects, features and advantages of the present invention will be apparent from the following detailed description of the exemplary embodiments of the invention in conjunction with the accompanying drawings, in which.

DETAILED DESCRIPTION

Figure 1:
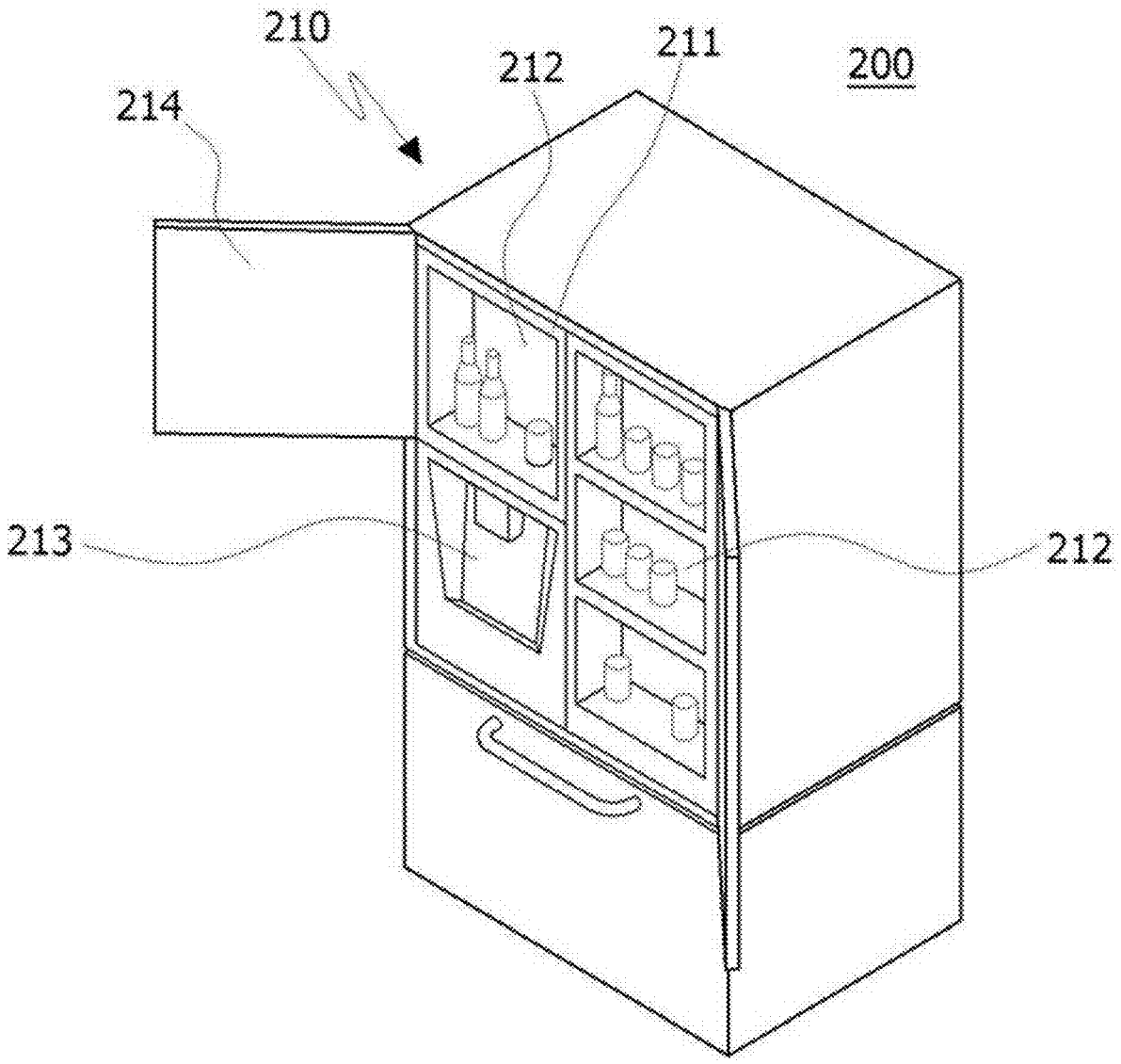
FIG. 1 is a front view showing a refrigerator according to an exemplary embodiment.

Hereinafter, embodiments of the present invention will be described in detail with reference to the attached drawings. It is to be understood that the disclosed embodiments are merely exemplary embodiments of the invention, which can be embodied in various forms. If it is determined that the detailed explanation on the well-known technology related to the invention makes the scope of the invention not clear, the explanation will be avoided for the brevity of the description. In the description and drawings, the corresponding parts in the embodiments of the invention are indicated by corresponding reference numerals.

In the description, the term 'coupled' or 'connected', as used herein, is defined as connected, although not necessarily directly, and not necessarily mechanically. To the contrarily, the term 'directly coupled' or 'directly connected', as used herein, is defined as connected without having any component disposed therebetween. In the description, when it is said that one portion is described as "includes" any component, one element further may include other components unless no specific description is suggested.

Hereinafter, an exemplary embodiment of the invention will be described in detail with reference to the attached drawings.

FIG. 1 is a front view showing a refrigerator according to an exemplary embodiment.

Referring to FIG. 1, a refrigerator 200 includes main doors 211 and sub-doors 214. The sub-doors 214 are connected to the main doors 211 to open and close the main doors 211. For example, the sub-doors 214 are made of glass to enable the insides of the main doors 211 to be seen by a user, while being not open by the user. For another example, the sub-doors 214 are made of LCD panels, LED panels, or other display panels, so that the user can obtain information even on the outside of the refrigerator using the sub-doors 214.

The main doors 211 include convenience space 212 and a dispenser 213 located therein. For example, in the case of the main door 211 with no dispenser, the convenience space 212 are formed on the entire main door 211. Even though the main doors 211 are not open, the user can access refrigerated foods such as beverages that are stored in the convenience space 212, so that the advantages of easy accessibility and energy conservation are provided for the user. For another example, in the case of the main door 211 with the dispenser 213, the accommodation space 212 is located at the top of the dispenser 213. When the sub-door 214 is open, that is, the accommodation space 212 is located at the height of the user's eyes. The refrigerated foods such as beverages are stored in the convenience space 212, and as the sub-doors 214 are open and closed by the user, he or she can access the refrigerated foods stored in the convenience space 212 more easily. As the main doors 211 closing a storage room 220 are not open, further, an amount of energy consumed can be greatly reduced.

The dispenser 213 is located at the underside of the accommodation space 212 to supply ice to the user. For example, the dispenser 213 is closed by the sub-door 214. As a result, external pollutants can be prevented from entering the dispenser 213 or the interior of the refrigerator 200 through the dispenser 213. As the dispenser 213 is closed by the sub-door 214, further, heat can be prevented from being transferred to an ice bucket 110 connected to the dispenser 213 or to an internal space of the storage room 220. Accordingly, energy conservation is more efficiently achieved.

Figure 2:
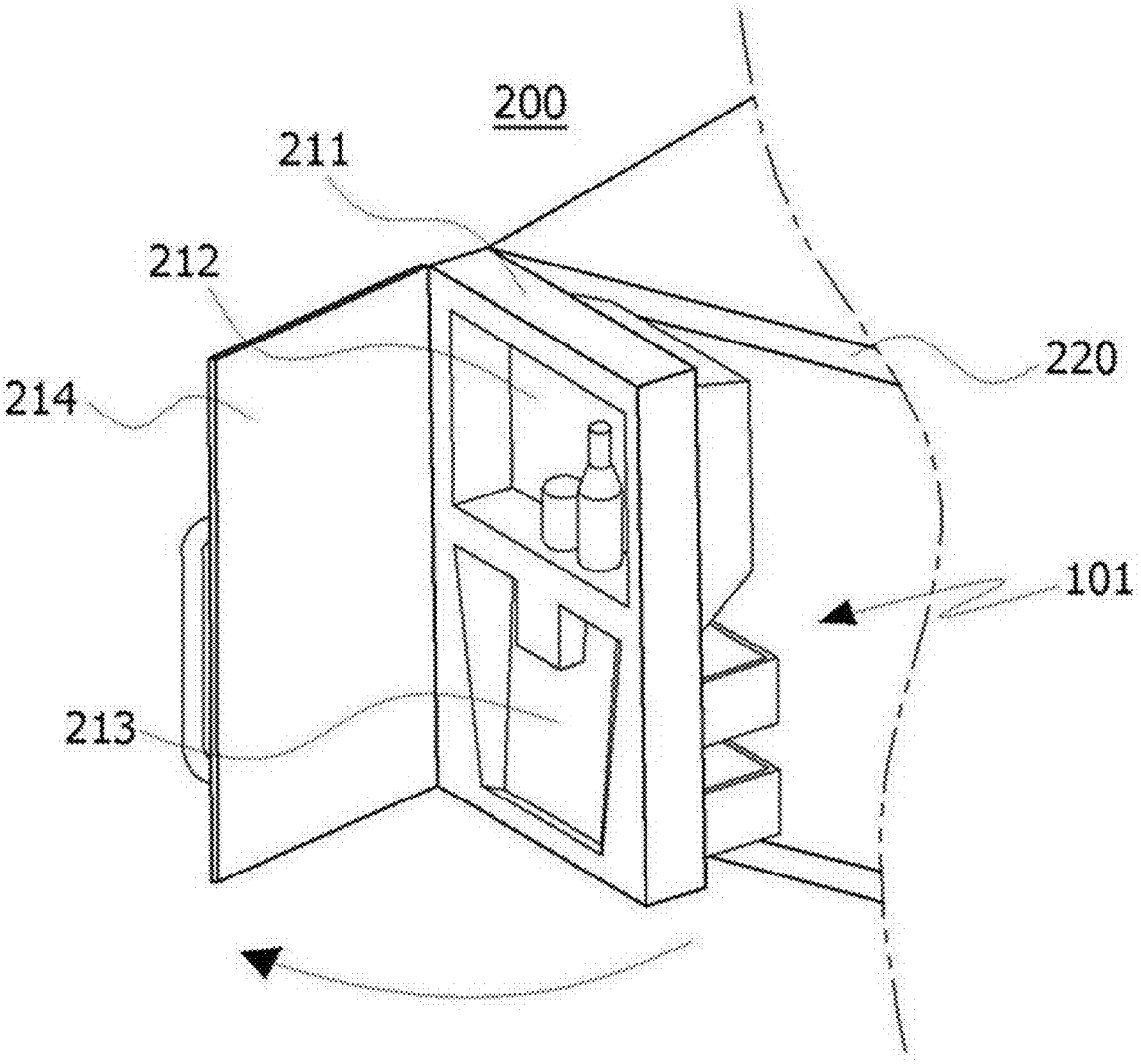
FIG. 2 is a perspective view showing one side main door of FIG. 1.

FIG. 2 is a perspective view showing the main door of FIG. 1.

Referring to FIG. 2, the main door 211 opens and closes the storage room 220, while sealing the storage room 220. If the main door 211 is open, in specific, the storage room 220 is completely open so that the user can easily access the storage room 220, that is, a refrigerating room 221 or a freezing room 222.

An ice making room 101 is connected to the main door 211. More specifically, the ice making room 101 is connected to the back of the accommodation space 212. An ice maker 100 and an ice bucket 110 as will be discussed later are located in the ice making room 101.

The underside of the ice making room 101 is connected to the dispenser 213 to supply the ice stored in the ice bucket 110 of the ice making room 101 to the outside through the dispenser 213.

Figure 3:
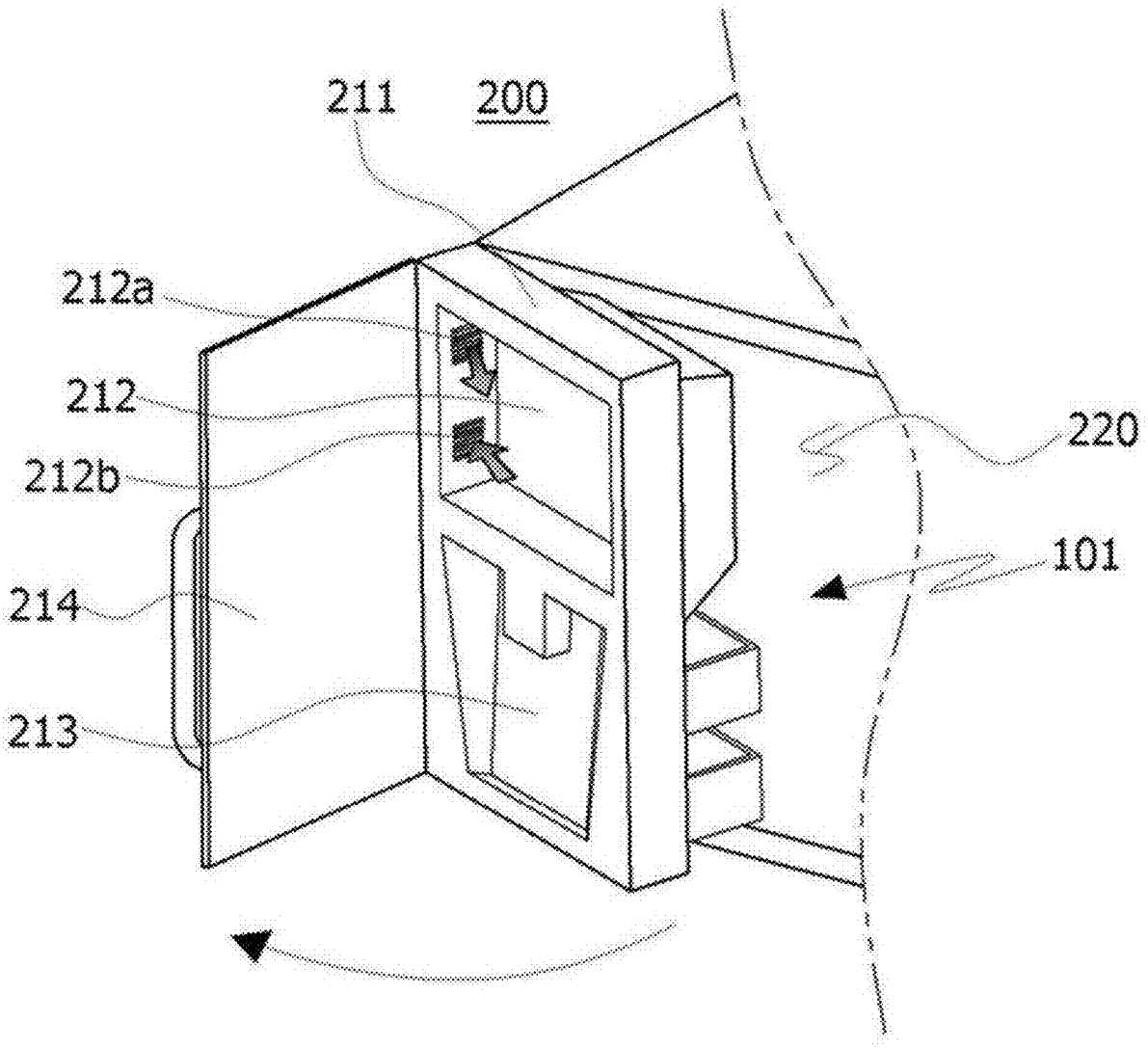
FIG. 3 is a perspective view showing an example of an accommodation space of FIG. 2.
Figure 4:
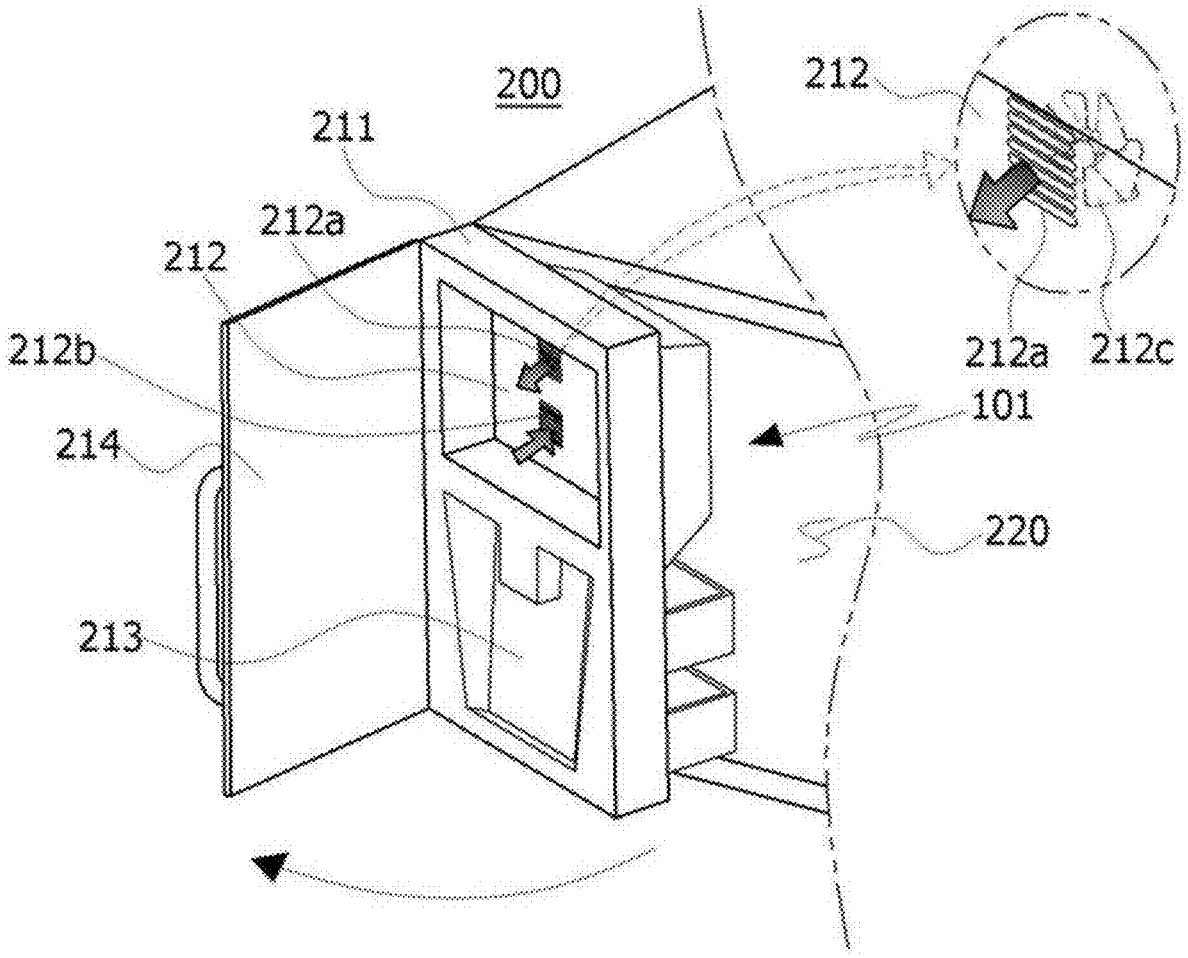
FIG. 4 is a perspective view showing another example of the accommodation space of FIG. 2.

FIG. 3 is a perspective view showing an example of the accommodation space of FIG. 2, and FIG. 4 is a perspective view showing another example of the accommodation space of FIG. 2.

Referring to FIGS. 3 and 4, a first cold air portion 212*a* and a second cold air portion 212*b* are formed in the accommodation space 212 of the main door 211. For example, the first cold air portion 212*a* and the second cold air portion 212*b* are formed on the surface where the accommodation space 212 comes into contact with the ice making room 101. Cold air is introduced from the first cold air portion 212*a* and is emitted from the second cold air portion 212*b*. The accommodation space 212 has a relatively higher temperature than the ice making room 101, and even if the cold air supplied and emitted to and from the ice making room 101 is induced to the accommodation space 212, accordingly, it is possible to refrigerate the accommodation space 212. That is, the temperature of the accommodation space 212 can be adjusted to a temperature above or below zero degree Celsius. Further, the air emitted from the second cold air portion 212*b* is induced to the refrigerating room 221 or the freezing room 222 to remove the moisture remaining in the convenience space 212, so that the sub-doors 214 can be prevented from being dewy.

A blowing fan 212*c* is connected to the first cold air portion 212*a*. The blowing fan 212*c* supplies cold air to the accommodation space 212 gently and blows air to allow the internal air of the accommodation space 212 to be circulated well. The internal air of the accommodation space 212 is emitted from the second cold air portion 212*b*. Further, the moisture in the internal air is removed and then supplied to the accommodation space 212 through the ice making room 101 again. Through such processes, the cold air from which moisture is removed is supplied to the accommodation space 212 to thus prevent the interior of the accommodation space 212 or the sub-door 214 from being dewy owing to a temperature difference.

Figure 5:
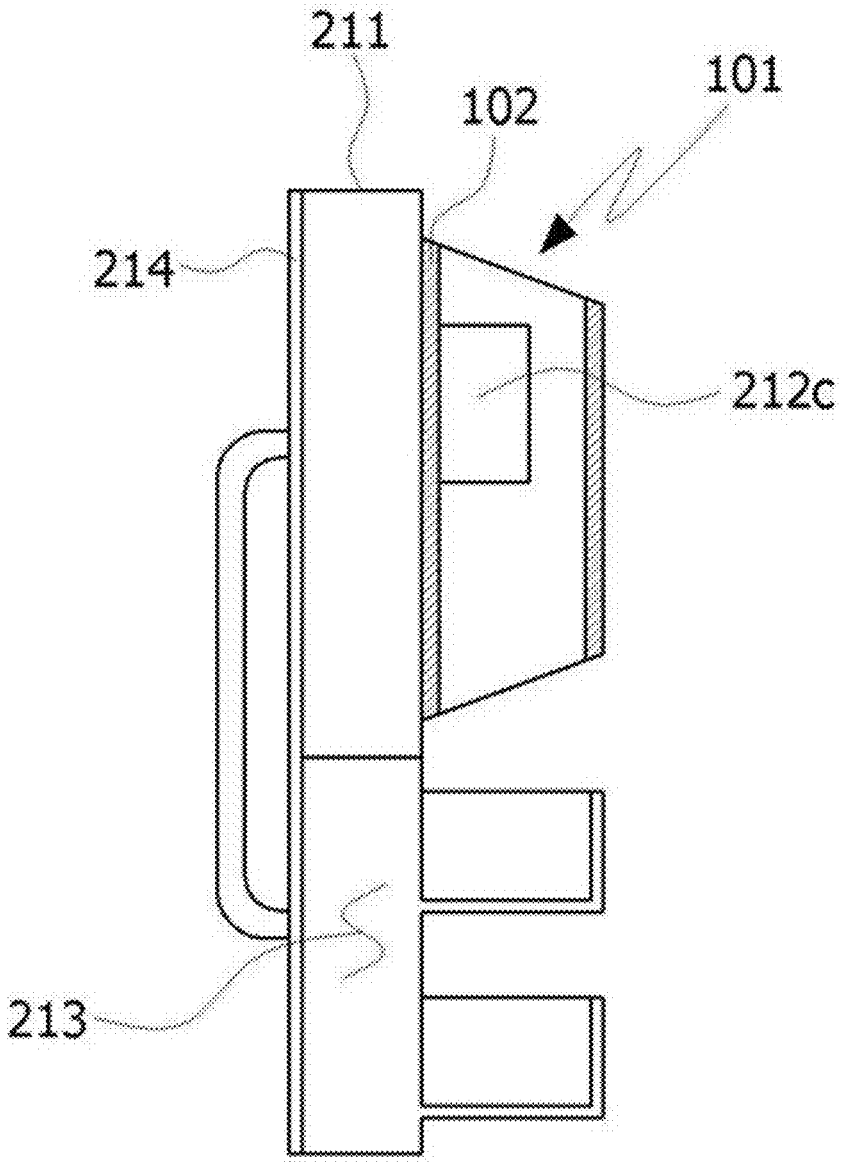
FIG. 5 is a perspective view showing the side surface of the main door of FIG. 2.

FIG. 5 is a perspective view showing the side surface of the main door of FIG. 2.

Referring to FIG. 5, the ice making room 101 has an insulation layer 102. The interior of the ice making room 101 is kept to a temperature below zero degree Celsius to make and store ice. The temperature of the ice making room 101 is relatively lower than the storage room 220 or the accommodation space 212, and if a lot of moisture exists in the cold air, dew condensation may occur around the ice making room 101 because of a temperature difference. Accordingly, heat transfer is prevented using the insulation layer 102 formed on the ice making room 101, thereby preventing the dew condensation from occurring. More specifically, the insulation layer 102 is a vacuum insulation panel. As a result, the insulation layer 102 is low in thickness to allow the ice making room 101 to be made to a relatively large size. Further, the insulation layer 102 prevents heat loss from occurring to allow the ice making room 101 to perform high-speed ice making.

The insulation layer 102 is formed between the accommodation space 212 and the ice making room 101. The dew condensation may occur in the accommodation space 212 by the heat received from the ice making room 101. More specifically, the sub-door 214 is open and closed more frequently than the main door 211, so that external air may be easily introduced through the sub-door 214. In this case, the external air has high humidity to cause the accommodation space 212 to be dewy. As mentioned above, the air in the accommodation space 212 is emitted to the freezing room 222 or an evaporator 235 from the second cold air portion 212*b*, and the cold air having relatively low humidity or the cold air from which moisture is removed is supplied through the second cold air portion 212*b* from the ice making room 101 to the accommodation space 212, thereby lowering the humidity of the accommodation space 212. Further, the insulation layer 102 blocks the cold heat received from the ice making room 100 to prevent the temperature at the back surface of the accommodation space 212 from being lowered. As a result, the accommodation space 212 can be prevented from being dewy.

The insulation layer 102 is formed in a direction where the ice making room 101 is oriented toward the storage room 220. For example, the storage room 220 is the refrigerating room 221. In this case, because the temperature of the ice making room 101 is lower than that of the storage room 220, the dew condensation may occur on the surface of the ice making room 101 owing to a temperature difference. Accordingly, the heat transfers to the surface of the ice making room 101 can be prevented using the insulation layer 102, thereby avoiding the occurrence of the dew condensation.

Figure 6:
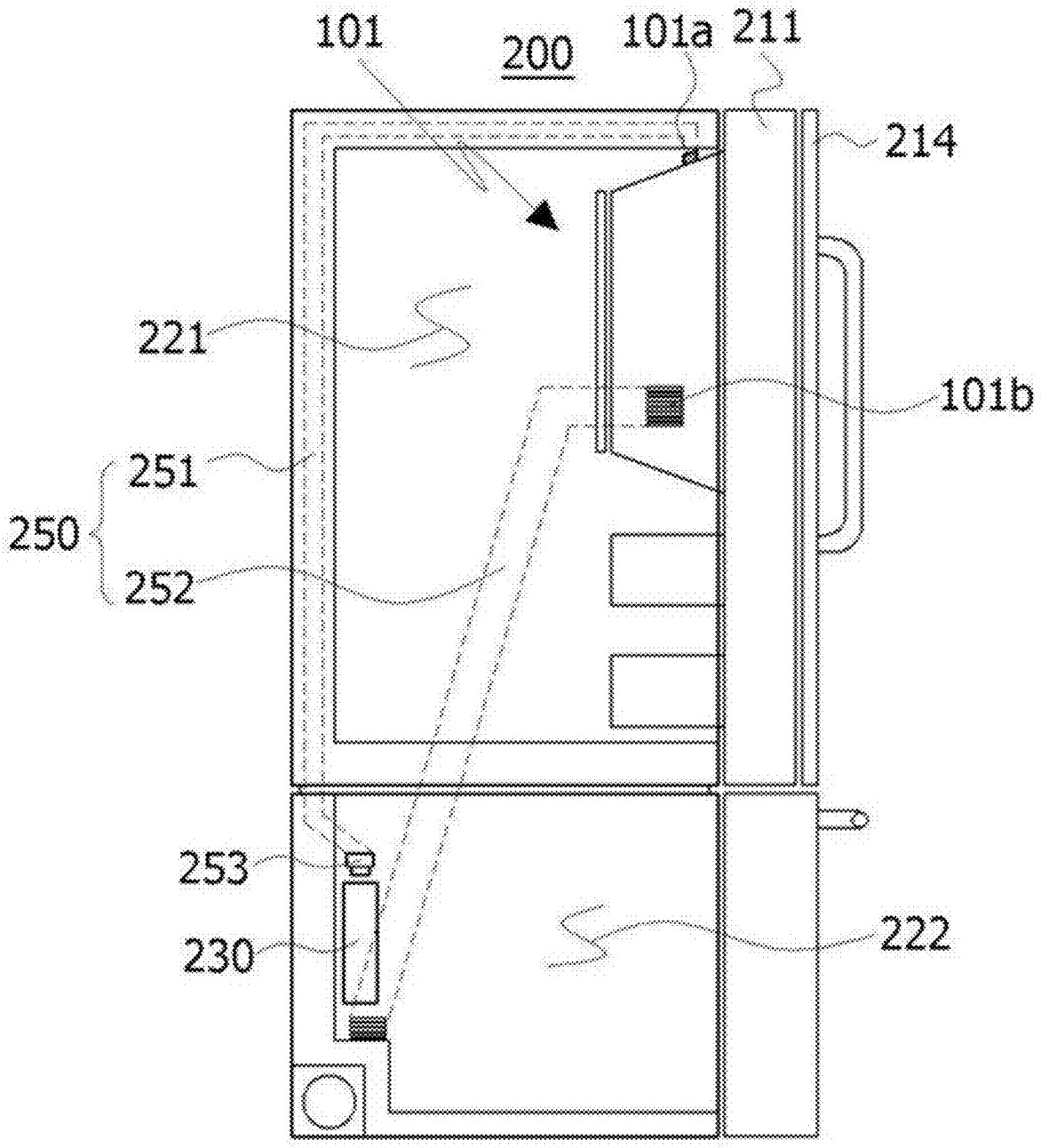
FIG. 6 is a side view showing a first example of cold air ducts connected to an ice making room of FIG. 2.

FIG. 6 is a side view showing a first example of cold air ducts connected to an ice making room of FIG. 2.

Referring to FIG. 6, the refrigerator 200 includes the refrigerating room 221 and the freezing room 222, and the refrigerating room 221 is located at the top of the freezing room 222. The evaporator 230 is located in the freezing room 222. The evaporator 230 generates the cold air by the heat transfer to the surrounding air, and the cold air is supplied to the freezing room 222 or the refrigerating room 221.

The ice making room 101 has the ice maker 100 and the ice bucket 110 disposed therein. They will be discussed later. The ice making room 101 has a cold air supply portion 101*a* and a cold air emission portion 101*b*. For example, the cold air supply portion 101*a* is formed at top of the ice making room 101. That is, the cold air generated from the evaporator 230 is directly supplied to the cold air supply portion 101*a* of the ice making room 101. As a result, the ice making room 101 supplies the cold air to the ice maker 100, and accordingly, the cold air generated from the evaporator 230 is directly transferred to the ice maker 100, so that high-speed ice making is performed. Because of the high-speed ice making, a substantially large amount of ice is produced.

The cold air emission portion 101*b* is formed at the side surface of the ice maker 100. The cold air emitted from the ice maker 100 is emitted through the cold air emission portion 101*b*, and the emitted cold air is supplied again to the evaporator 230. As water is supplied to the interior of the ice making room 101 and turns into ice, a relatively large amount of moisture may exist in the ice making room 101. Accordingly, the cold air emitted from the ice making room 101 is transferred to the evaporator 230 so as to remove the moisture therefrom. As a result, while the moisture is prevented from being raised in the storage room 220 of the refrigerator 200, the ice making speed becomes high to produce a substantially large amount of ice.

Cold air ducts 250 are provided to connect the cold air supply portion 101*a* and the evaporator 230 to each other. More specifically, the cold air ducts 250 are a cold air supply duct 251 and a cold air emission duct 252. The cold air supply duct 251 is connected to the evaporator 230, extends to the back surface of the refrigerator 200 and the ceiling of the refrigerator 200, and connected to the cold air supply portion 101*a* of the ice making room 101. As the cold air is supplied to the ice making room 101 from the upper portion of the refrigerator 200, the cold air naturally passes through the ice maker 100 and the ice bucket 110, without having any separate power. More specifically, the lower a temperature of air is, the higher a density of air is, so that the cold air naturally sinks down. That is, the entire region of the ice making room 101 becomes cold. Accordingly, the cold air is supplied to the cold air supply portion 101*a* formed at the top of the ice making room 101, thereby more effectively forming a flow of air in the ice making room 101.

A cold air fan 253 is located between the cold air supply duct 251 and the evaporator 230. The cold air fan 253 supplies the cold air generated from the evaporator 230 to the ice making room 101 through the cold air supply duct 251. For example, the cold air fan 253 is a centrifugal fan appropriate for a high static pressure of a duct. As a result, the cold air supply duct 251 can be reduced in size, and the flow rate of air flowing along the cold air supply duct 251 can be increased, so that because of high-speed ice making, a substantially large amount of ice can be produced.

Because the cold air fan 253 has high-speed air blowing, further, high frequency noise is generated from the cold air fan 253, but as the high frequency noise has a short wavelength, it is absorbed and blocked in a narrow space, so that the high frequency noise is handled more easily than low frequency noise.

The cold air emission duct 252 is connected to the cold air emission portion 101*b* of the ice making room 101. As mentioned above, the formation of the cold air ducts 250 for removing the moisture from the cold air to directly supply and emit the cold air to and from the ice making room 101 enables a substantially large amount of ice to be produced owing to the high-speed ice making.

The cold air emission portion 101*b* is formed at the side surface of the ice making room 101. For example, the ice making room 101 has a supply part formed on the underside thereof and connected to the dispenser 213 to supply ice to the dispenser 213. To prevent the cold air from being emitted to the outside, accordingly, the cold air emission portion 101*b* is formed at the side surface of the ice making room 101 to supply the cold air to the evaporator 230 through the cold air emission duct 252.

Figure 7:
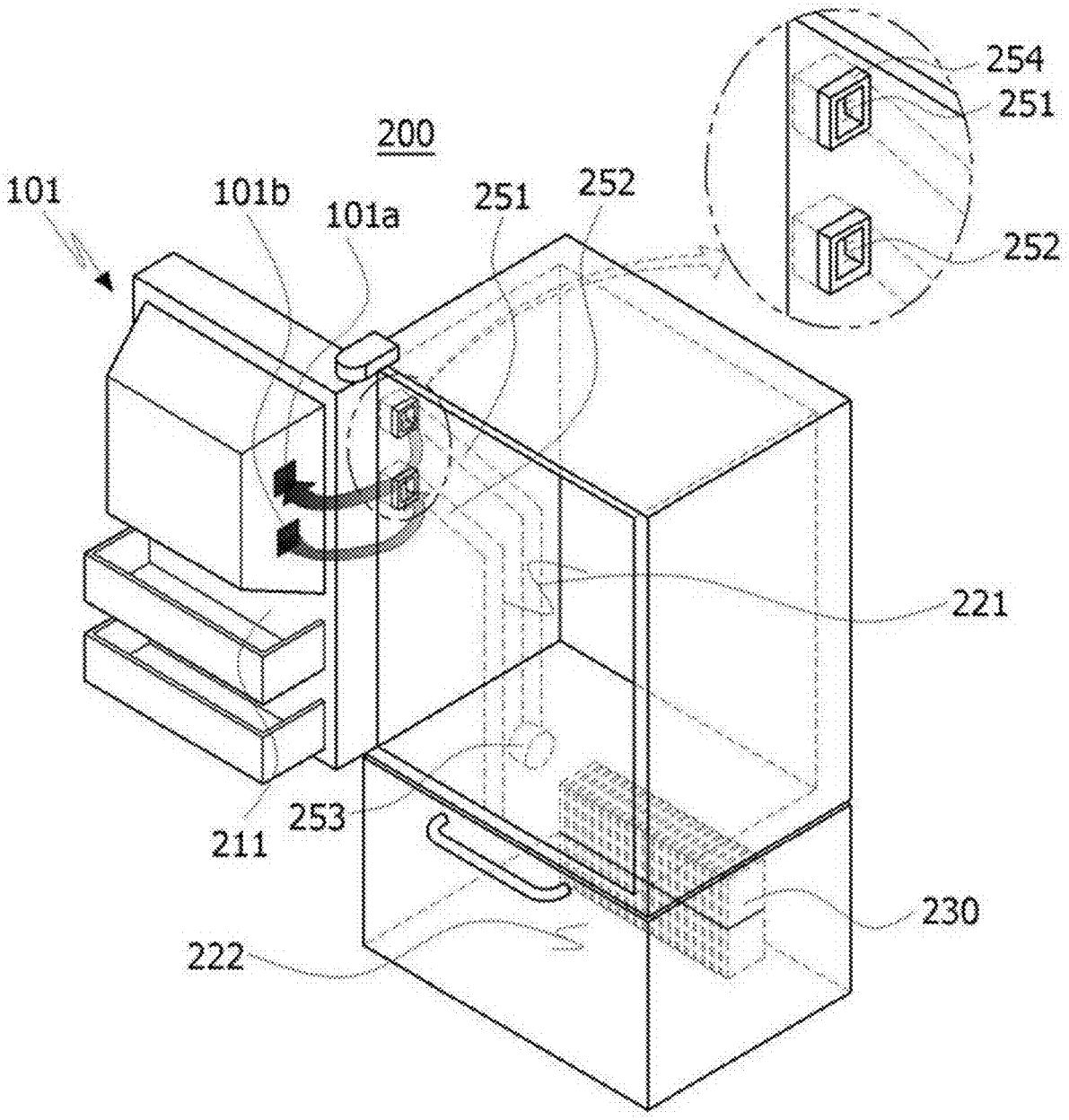
FIG. 7 is a perspective view showing a second example of the cold air ducts connected to the ice making room of FIG. 2.

FIG. 7 is a perspective view showing a second example of the cold air ducts connected to the ice making room of FIG. 2.

Referring to FIG. 7, a cold air supply portion 101*a* and a cold air emission portion 101*b* are formed at the side surface of the ice making room 101. The cold air supply portion 101*a* is formed above the cold air emission portion 101*b*. That is, the lower a temperature of air is, the higher a density of air is, so that the heavy cold air naturally sinks down. Accordingly, the cold air supplied from the cold air supply portion 101*a* is naturally induced to the cold air emission portion 101*b* and emitted from the cold air emission portion 101*b*.

Cold air ducts 250 are connected to the evaporator 230 of the freezing room 222 and to the ice making room 101. The cold air ducts 250 are arranged along the side wall of the refrigerator 200. For example, the cold air ducts 250 are located on the insides of the side wall of the refrigerator 200. For another example, the cold air ducts 250 are located exposedly from the side wall of the refrigerator 200. In this case, only portions of the cold air ducts 250 are exposed. As a result, the cold air ducts 250 are located on the side wall of the refrigerator 200, thereby ensuring the spaces of the refrigerating room 221 and the freezing room 222 to the maximum.

The cold air ducts 250 are a cold air supply duct 251 and a cold air emission duct 252, and a cold air fan 253 is located on the cold air supply duct 251. The cold air fan 253 supplies the cold air generated from the evaporator 230 to the cold air supply duct 251.

The cold air ducts 250 have caps 254 disposed on the end portions connected to the ice making room 101. The caps 254 are located between the cold air ducts 250 and the cold air supply portion 101*a* and the cold air emission portion 101*b*, thereby preventing the cold air from leaking to the outside. For example, the caps 254 are made of a flexible material. Accordingly, as the ice making room 101 comes into contact with the cold air ducts 250, the caps 254 are pressed against the cold air supply portion 101*a* and the cold air emission portion 101*b* of the ice making room 101 to seal the cold air supply portion 101*a* and the cold air emission portion 101*b*. As a result, the cold air supplied and emitted through the cold air ducts 250 is prevented from leaking to the outside. For another example, the caps 254 are disposed on the end portions of the cold air ducts 250 and inserted into the cold air supply portion 101*a* and the cold air emission portion 101*b*. In this case, the caps 254 are inserted into the cold air supply portion 101*a* and the cold air emission portion 101*b* and located on the inner wall of the refrigerator 200 to supply the cold air supplied from the cold air supply duct 251 to the cold air supply portion 101*a*, without any loss and to move the cold air from the cold air emission portion 101*b* to the cold air emission duct 252, without any loss. As a result, the cold air, which is supplied to the ice making room 101 or emitted from the ice making room 101, is supplied to the refrigerating room 221, thereby preventing dew condensation from occurring.

Figure 8:
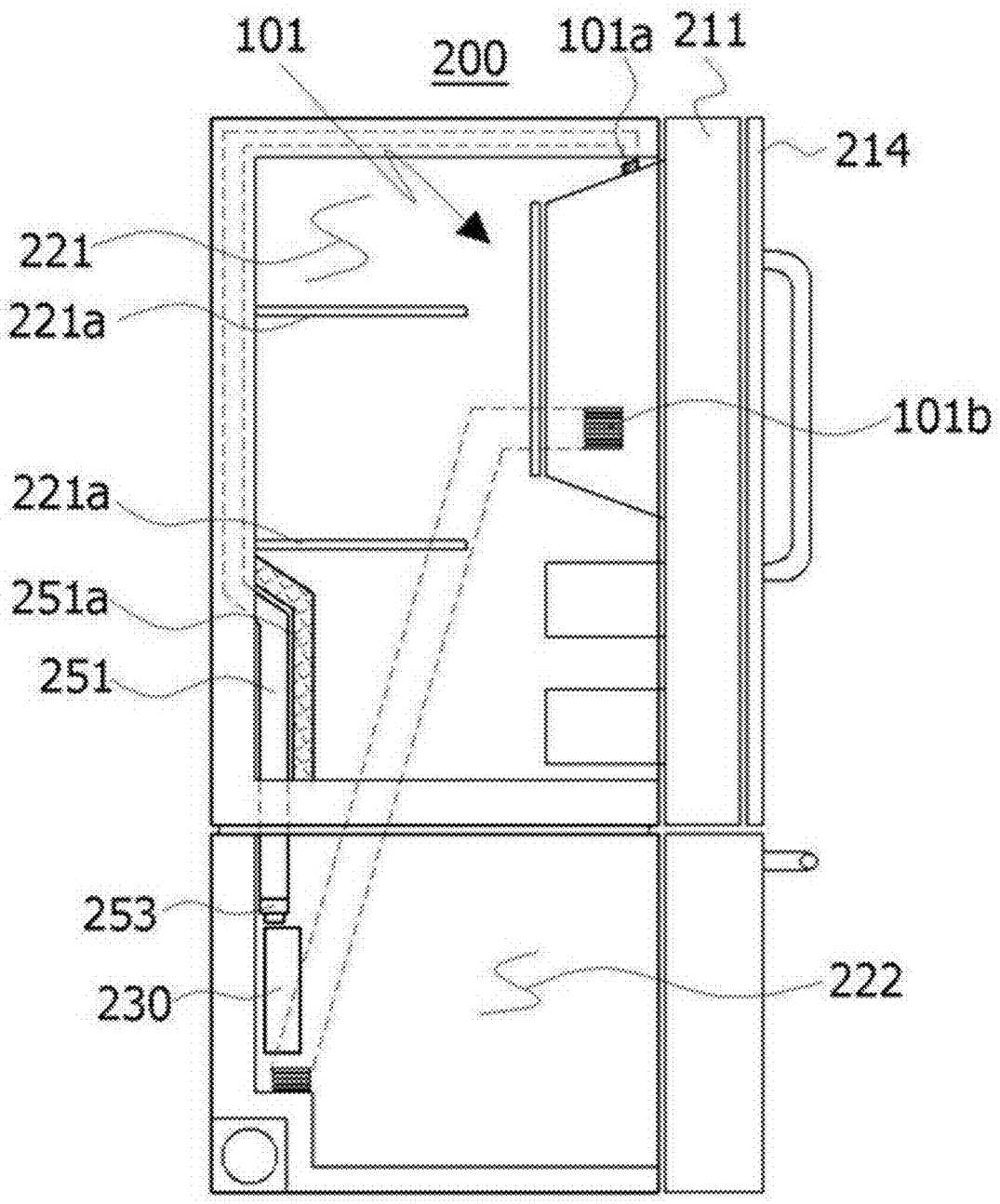
FIG. 8 is a side view showing a third example of the cold air ducts connected to the ice making room of FIG. 2.

FIG. 8 is a side view showing a third example of the cold air ducts connected to the ice making room of FIG. 2.

Referring to FIG. 8, a cold air supply duct 251 is exposed to the refrigerating room 221. The cold air supply duct 251 passes through the refrigerating room 221 and the freezing room 222 and is connected to the evaporator 230. For example, the cold air supply duct 251 is located to extend to the top of the refrigerating room 221 along the rear wall of the refrigerating room 221 and supplies the cold air to the top of the ice making room 101. In this case, the cold air supply duct 251 is exposed from the rear wall of the refrigerating room 221 and extends to the evaporator 230 located in the freezing room 222. That is, the cold air supply duct 251 is located vertically from the evaporator 230 to a portion of the refrigerating room 221, without being bent, the cold air supply duct 251 having a narrow area has higher density than the surrounding cold air, so that the cold air supply duct 251 effectively supplies the heavy cold air generated from the evaporator 230 to the ice making room 101 at a high flow rate. For another example, the exposed cold air supply duct 251 supports one shelf of the plurality of shelves 221*a* disposed in the refrigerating room 221 against to structurally stabilize the shelf, so that things having heavier weights can be supported.

An insulation member 251*a* is located along the cold air supply duct 251. As a result, dew condensation is prevented from occurring because of a temperature difference between the surface of the cold air supply duct 251 and the refrigerating room 221.

Figure 9:
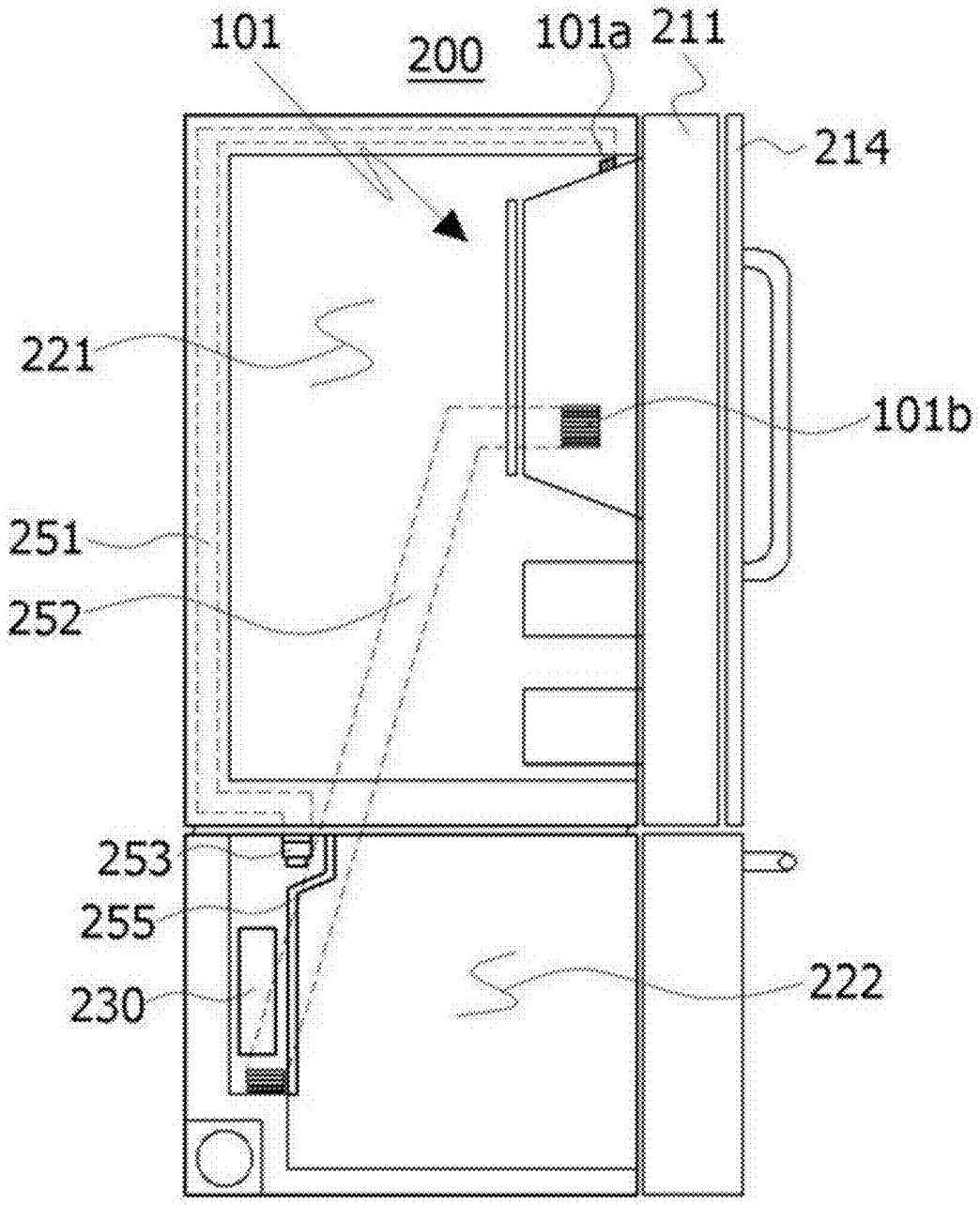
FIG. 9 is a side view showing a fourth example of the cold air ducts connected to the ice making room of FIG. 2.

FIG. 9 is a side view showing a fourth example of the cold air ducts connected to the ice making room of FIG. 2.

Referring to FIG. 9, cold air ducts 250 extend to be exposed above the evaporator 230 or by the evaporator 230. For example, a cold air fan 253 is located on a cold air duct end portion 255. The cold air supplied by the cold air fan 253 is supplied to a cold air supply duct 251 through the cold air duct end portion 255. In this case, the area of the cold air duct end portion 255 toward the evaporator 230 is larger than that toward the cold air supply duct 251. That is, the cold air duct end portion 255 supplies the cold air to the cold air supply duct 251 at a high speed, like a nozzle. Further, the cold air duct end portion 255 having a relatively small area supplies the cold air hard to be supplied to the cold air supply duct 251 to the cold air supply duct 251, without any loss, thereby supplying a large amount of cold air to the ice making room 101. For another example, the cold air duct end portion 255 surrounds the evaporator 230 located in the freezing room 222. That is, the evaporator is located inside the cold air duct end portion 255, and accordingly, the cold air generated from the evaporator 230 is effectively supplied to the cold air supply duct 251. As a result, the cold air duct end portion 255 has high density so that it can effectively supply the heavy cold air to the cold air supply duct 251 having a relatively small area.

Figure 10:
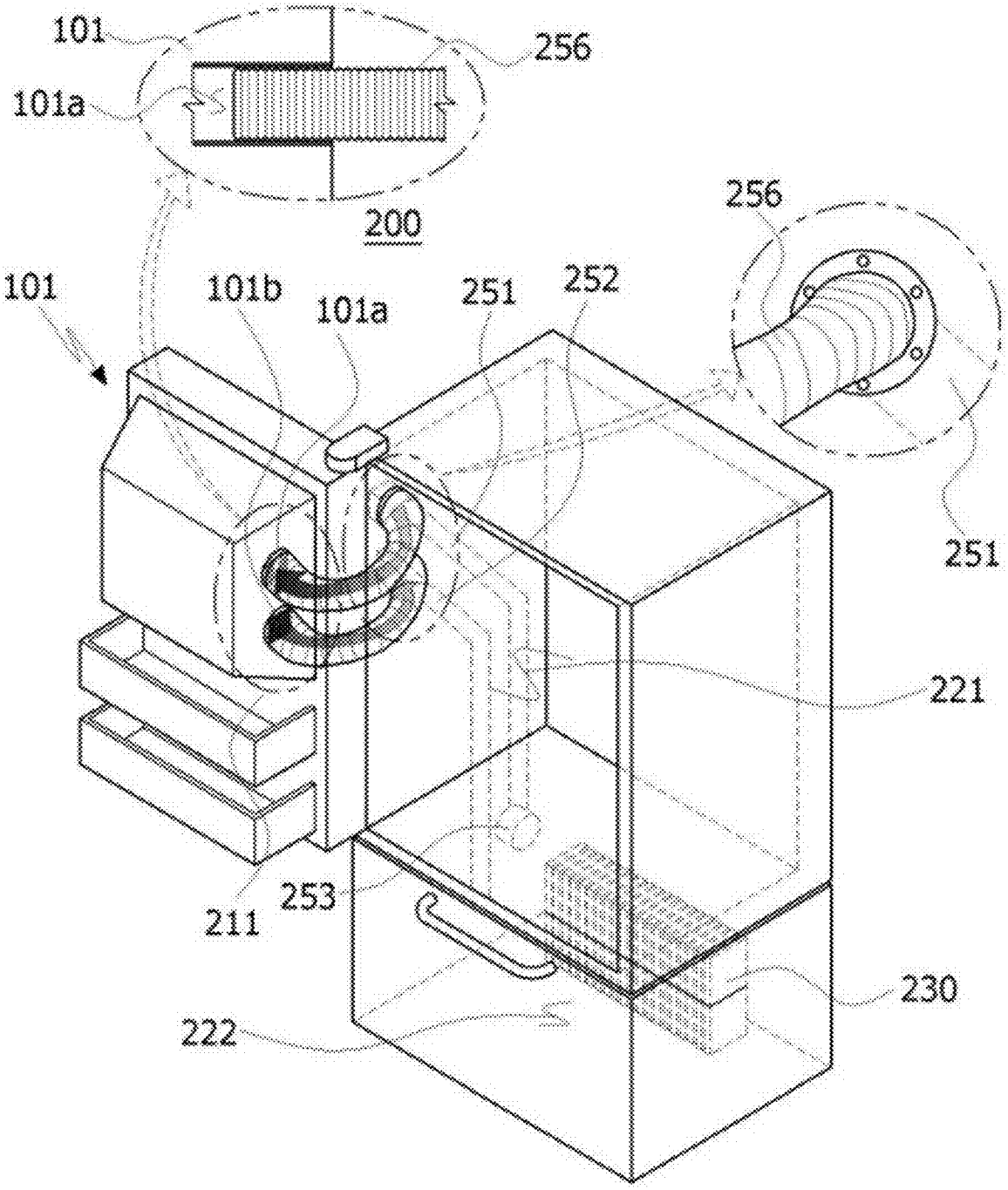
FIG. 10 is a perspective view showing a fifth example of the cold air ducts connected to the ice making room of FIG. 2.

FIG. 10 is a perspective view showing a fifth example of the cold air ducts connected to the ice making room of FIG. 2.

Referring to FIG. 10, cold air ducts 250 and the ice making room 101 are connected to each other via bellows tubes 256. The bellows tubes 256 are connected to the end portions of the cold air ducts 250 and to the end portion of the ice making room 101. For example, the bellows tubes 256 are corrugated tubes. That is, the bellows tubes 256 correspond to the lengths changed between the ice making room 101 and the cold air ducts 250 according to the opening and closing of the main door 211. More specifically, the bellows tubes 256 are inserted into the ice making room 101 and connected to the inner wall of the ice making room 101. That is, when the main door 211 is closed, the bellows tubes 256 are inserted into the inner wall of the ice making room 101 by the compressed lengths thereof. As a result, the cold air is supplied deeply to the ice making room 101 through the corresponding bellows tube 256, without any loss, when the main door 211 is closed, thereby expecting high-speed ice making. Further, the cold air emitted from the ice making room 101 is emitted directly through the corresponding bellows tube 256, and accordingly, the cold air is emitted to the evaporator 230 through a cold air emission duct 252, without leaking to the refrigerating room 221. Even when the main door 211 is open, further, ice making is kept in the ice making room 101. As a result, a substantially large amount of ice is produced because of high-speed ice making.

Figure 11:
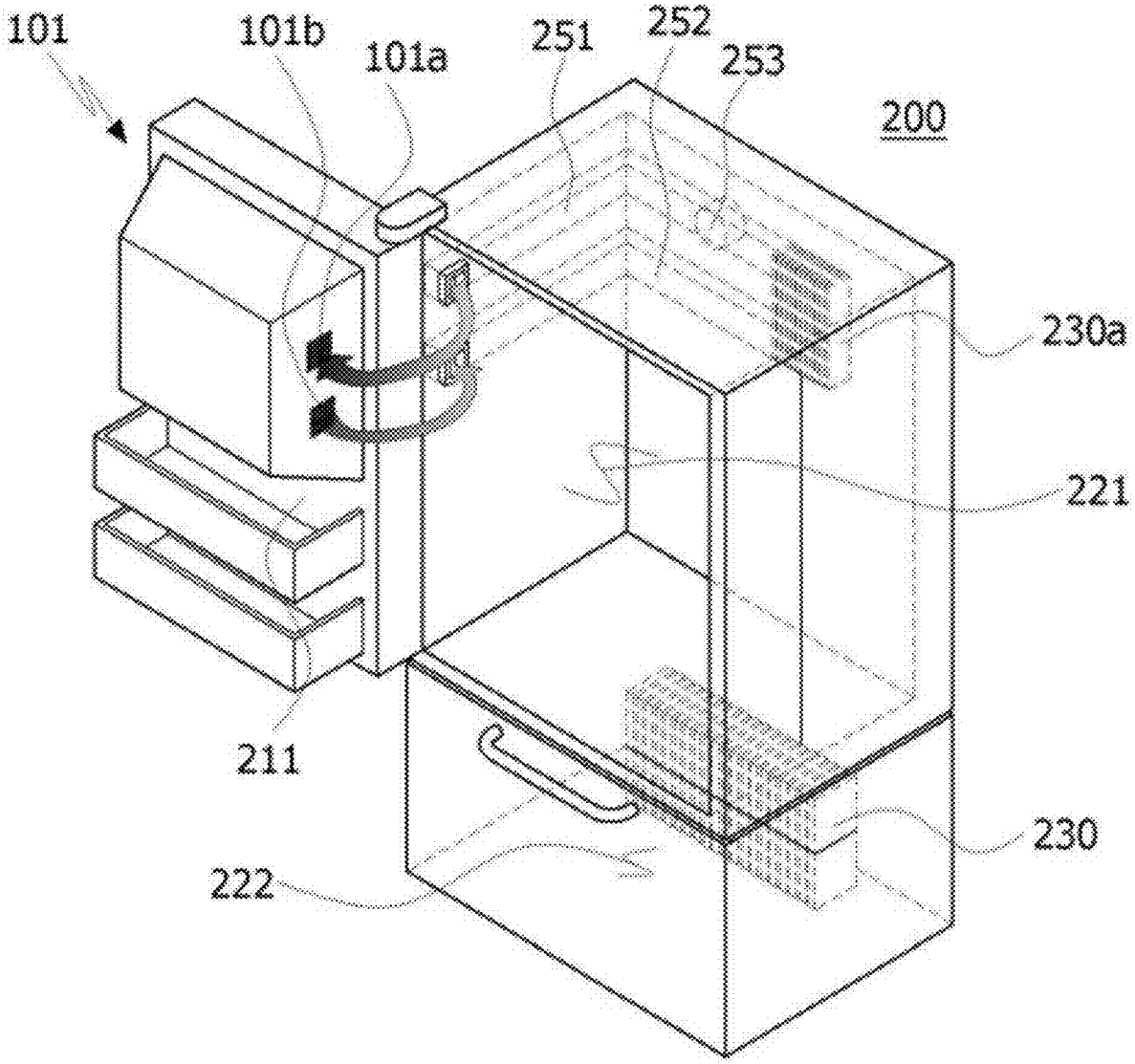
FIG. 11 is a perspective view showing a sixth example of the cold air ducts connected to the ice making room of FIG. 2.

FIG. 11 is a perspective view showing a sixth example of the cold air ducts connected to the ice making room of FIG. 2.

Referring to FIG. 11, the refrigerator 200 has evaporators 230*a* and 230 disposed in the refrigerating room 221 and the freezing room 222. The evaporator 230*a* disposed in the refrigerating room 221 produces the cold air for the refrigerating room 221. In this case, cold air ducts 250 connect the evaporator 230*a* disposed in the refrigerating room 221 to the ice making room 101. More specifically, the cold air ducts 250 are reduced in length and simplifiedly formed in flow path, and accordingly, the cold air flows to the ice making room 101, without having any high resistance inside the cold air ducts 250. The cold air emitted from the ice making room 101 may move at a low speed because of low pressure. Accordingly, the cold air ducts 250 are shortened in length, thereby ensuring that the cold air is circulated more gently.

A cold air supply duct 251 and a cold air emission duct 252 are connected to the evaporator 230*a* and extend along the rear and side wall surfaces of the refrigerator 200. In this case, a cold air fan 253 is located between the cold air supply duct 251 and the evaporator 230*a*. As a result, the cold air generated from the evaporator 230*a* is transferred stably to the ice making room 101 through the cold air supply duct 251 at a high speed.

A cold air supply portion 101*a* and a cold air emission portion 101*b* of the ice making room 101 are formed at the corresponding positions to the cold air ducts 250. For example, the cold air supply portion 101*a* and the cold air emission portion 101*b* are formed on the surface where the ice making room 101 comes into contact with the refrigerating room 221. In this case, the cold air supply portion 101*a* is formed above the cold air emission portion 101*b*. As mentioned above, the cold air is supplied at the higher position than the cold air emission portion 101*b* and naturally moves to the ice maker 100 and the ice bucket 110.

The supply of the cold air through the cold air ducts 250 is controlled according to the opening and closing of the main door 211. For example, blocking plates are disposed inside the cold air ducts 250 to close the cold air ducts 250. When the cold air ducts 250 are connected to the cold air supply portion 101*a* and the cold air emission portion 101*b* of the ice making room 101, the blocking plates push up to tops of the interior of the cold air ducts 250 with protrusions formed on the ice making room 101 so that they open the interiors of the cold air ducts 250. For another example, flexible caps openable to both sides thereof are connected to the end portions of the cold air ducts 250. That is, when the ice making room 101 is connected to the cold air ducts 250, the cold air supply portion 101*a* and the cold air emission portion 101*b* of the ice making room 101 push the caps toward the interiors of the cold air ducts 250 to open the interiors of the cold air ducts 250. As a result, when the main door 211 is closed to connect the cold air ducts 250 to the ice making room 101, the cold air is supplied or emitted.

Figure 12:
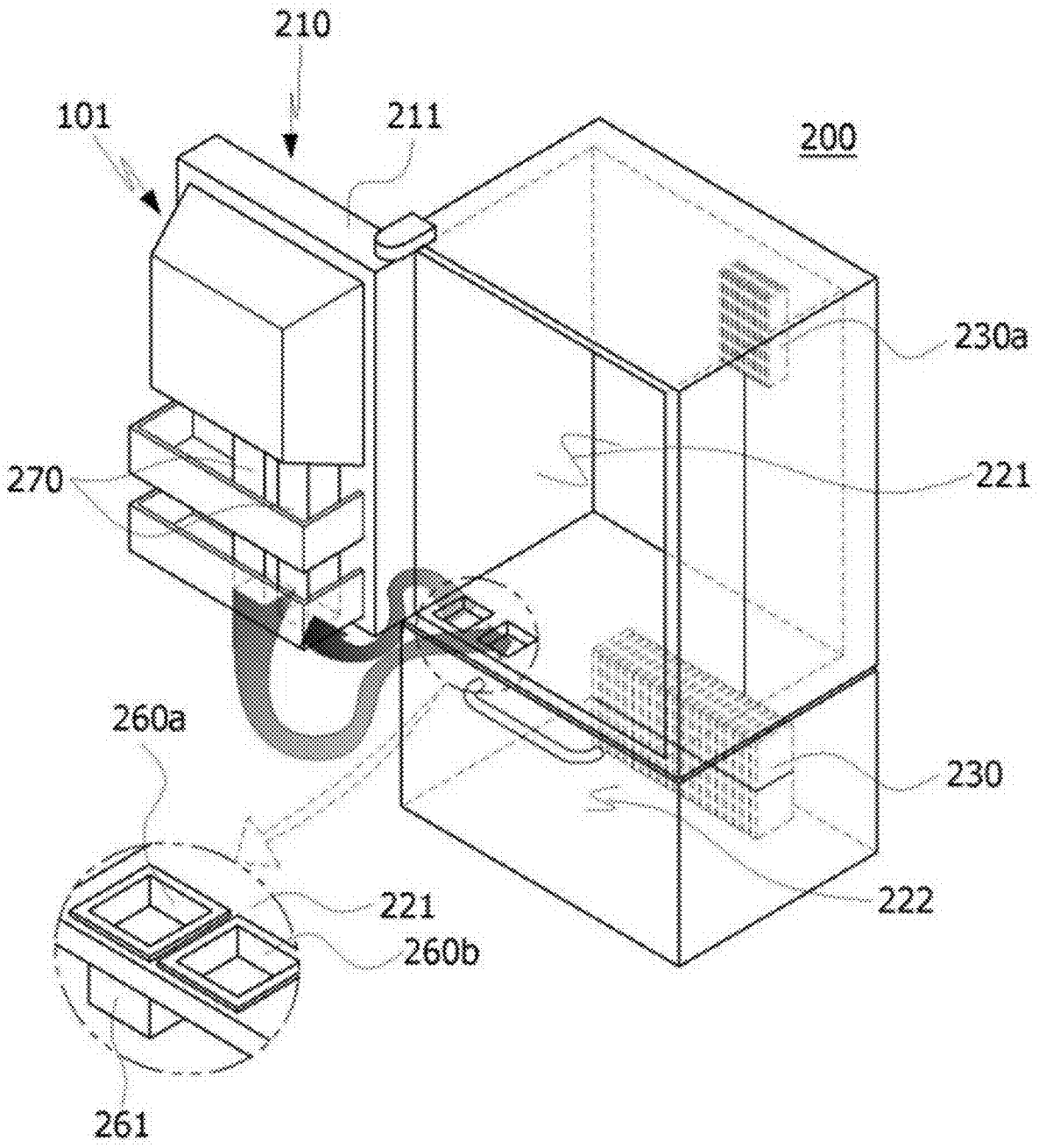
FIG. 12 is a perspective view showing an example of cold air passages connected to the main door of FIG. 2.

FIG. 12 is a perspective view showing an example of cold air passages connected to the main door of FIG. 2.

Referring to FIG. 12, the refrigerating room 221 is located at the top of the freezing room 222. The cold air of the freezing room 222 is directly supplied to the ice making room 101 through cold air passages 260. More specifically, the cold air passages 260 are formed at the bottom surface of the refrigerating room 221, and circulating ducts 270 of the main door 211 are located at the corresponding positions to the cold air passages 260.

The circulating ducts 270 are disposed on the main door 211. For example, the circulating ducts 270 are disposed on the inside of the main door 211 and not seen from the outside, but they are connected to the ice making room 101. Accordingly, the cold air received from the cold air passages 260 is transferred to the ice making room 101. For example, a blowing fan 261 is connected to a cold air supply portion of the cold air passages 260. Through the formation of the blowing fan 261, accordingly, the cold air of the freezing room 222 is supplied more easily to the ice making room 101 through the circulating ducts 270. In this case, the cold air of the freezing room 222 is supplied directly to the ice making room 101, and the cold air emitted from the ice making room 101 is emitted directly to the freezing room 222, so that the cold air transferred to the ice making room 101 is circulated at a high speed to produce a substantially large amount of ice because of high-speed ice making.

The cold air passages 260 are formed at the bottom surface of the refrigerating room 221, and to prevent foreign substances from entering the cold air passages 260 when the main door 211 is open, accordingly, caps are connected to the cold air passages 260. As mentioned above, the caps are openable to both sides thereof and made of a flexible material. While the foreign substances are prevented from entering the cold air passages 260, as a result, the cold air of the freezing room 222 is supplied to the ice making room 101 through the circulating ducts 270 at a high speed when the main door 211 is connected to the cold air passages 260.

Figure 13:
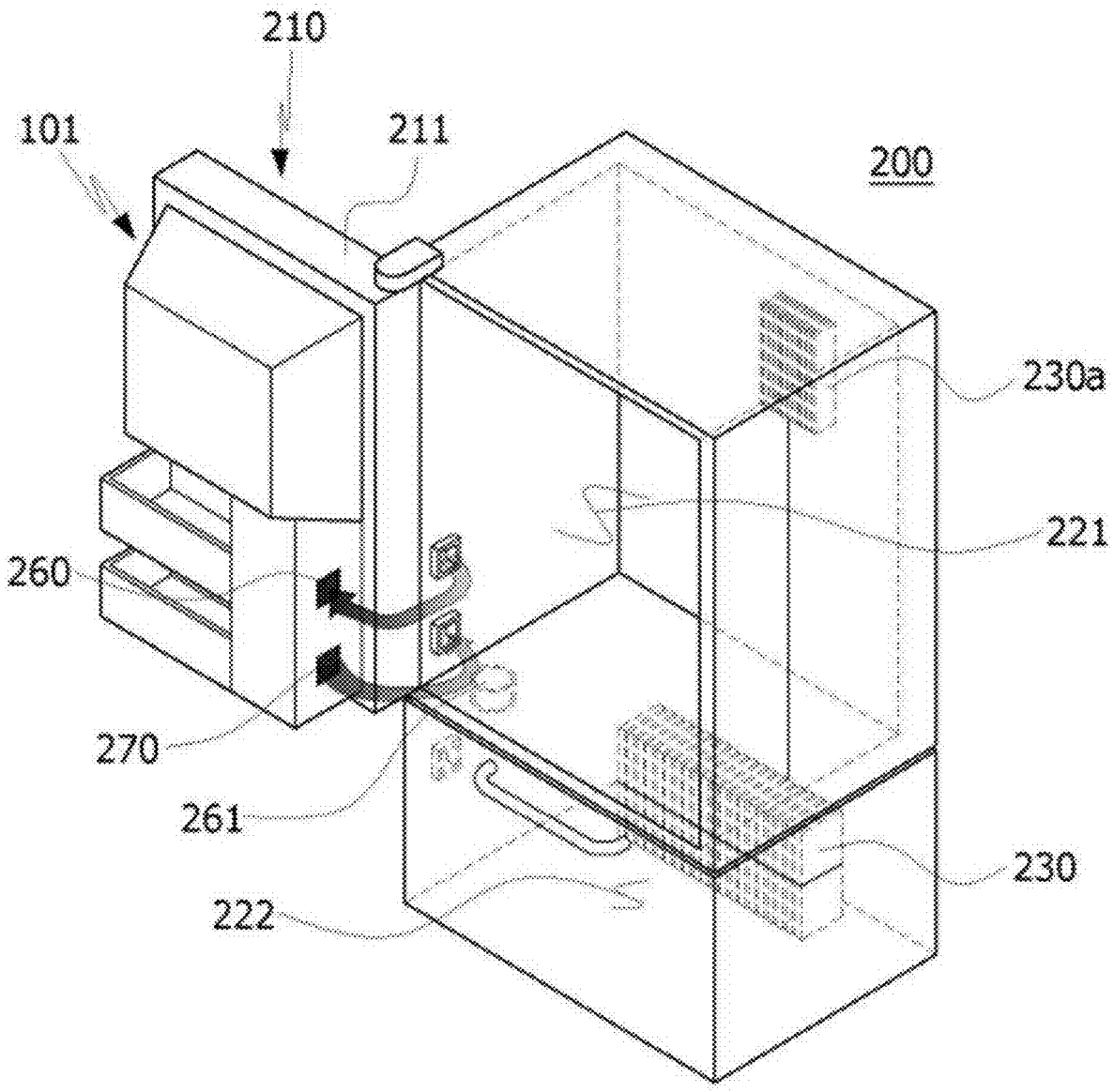
FIG. 13 is a perspective view showing another example of the cold air passages connected to the main door of FIG. 2.

FIG. 13 is a perspective view showing another example of the cold air passages connected to the main door of FIG. 2.

Referring to FIG. 13, cold air passages 260 connect the freezing room 222 and the refrigerating room 221 to each other. More specifically, the cold air passages 260 are formed on the side wall of the freezing room 222 and the side wall of the refrigerating room 221. The cold air is supplied and emitted to and from the side wall of the refrigerating room 221 through the cold air passage 260 formed on the side wall of the freezing room 222. When the main door 211 is closed, circulating ducts 270 located on the main door 211 are connected to the cold air passages 260 formed on the side surface of the refrigerating room 221. In this case, the cold air of the freezing room 222 is supplied to the circulating ducts 270 through the cold air passages 260, and the circulating ducts 270 supply the cold air to the ice making room 101. In the case where the cold air passages 260 are formed on the side surface of the refrigerator 200, it is easy to prevent foreign substances from entering the cold air passages 260. Accordingly, the interiors of the cold air passages 260 are kept cleaned to ensure easier supply of cold air.

Figure 14:
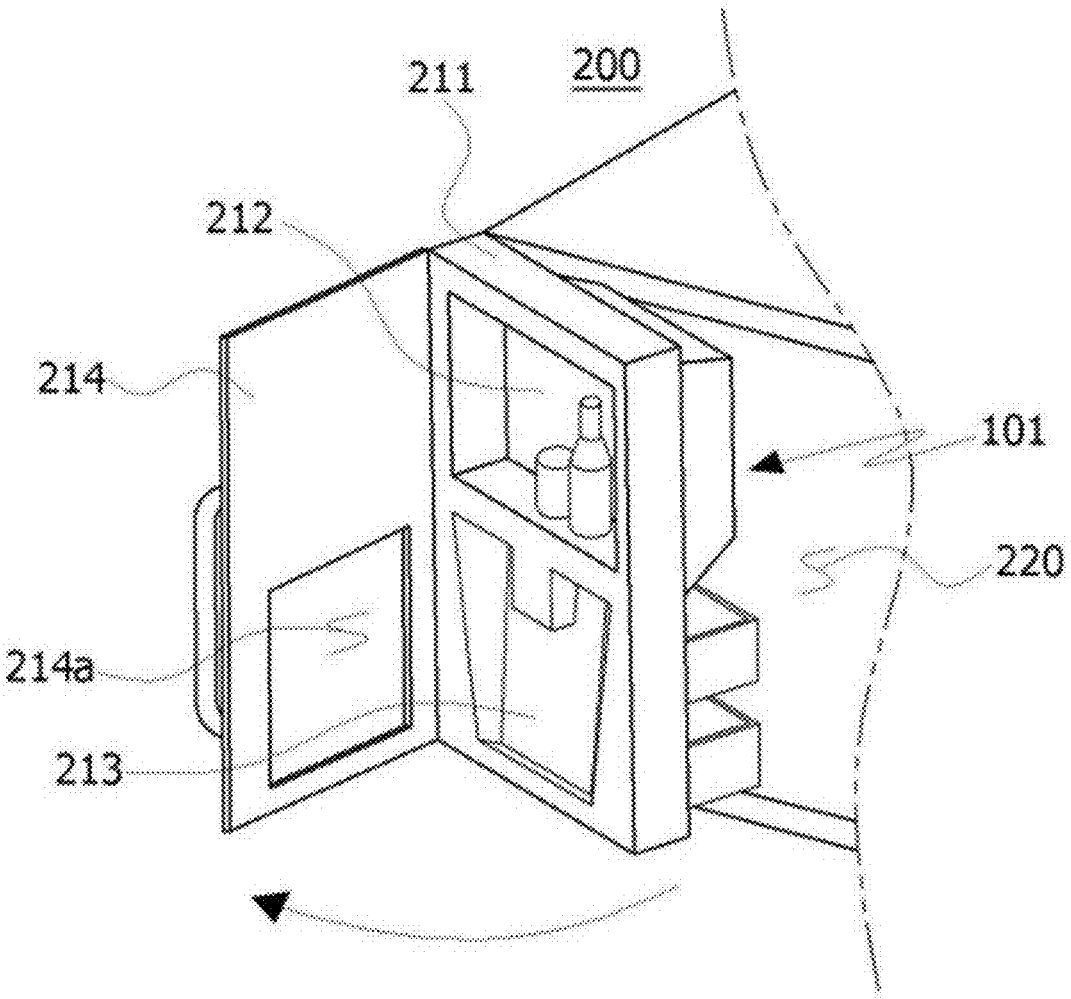
FIG. 14 is a perspective view showing the sub-door of FIG. 10.

FIG. 14 is a perspective view showing the sub-door of FIG. 2.

Referring to FIG. 14, the sub-door 214 has an opening 214*a* formed on the space corresponding to the dispenser 213. In this case, normally, the dispenser 213 is in an open state. When the ice or purified water is taken from the dispenser 213, accordingly, the number of unnecessary opening and closing times of the sub-door 214 can be reduced, thereby enhancing the energy efficiency. Further, the frequent opening and closing of the sub-door 214 causes the accommodation space 212 to be dewy, and accordingly, the closed time of the accommodation space 212 is ensured to the maximum, thereby reducing the possibility of dew condensation.

For another example, the sub-door 214 opens the portions corresponding to the accommodation space 212 and the dispenser 213, respectively. For example, the sub-door 214 is divided into upper and lower sub-doors. The upper sub-door 214 opens the accommodation space 212. The lower sub-door 214 opens the dispenser 213. In this case, the pollutants entering the dispenser 213 can be reduced, the heat transfer generated through the dispenser 213 can be blocked, and the accommodation space 212 is kept in a closed state, thereby enhancing the energy efficiency.

Figure 15:
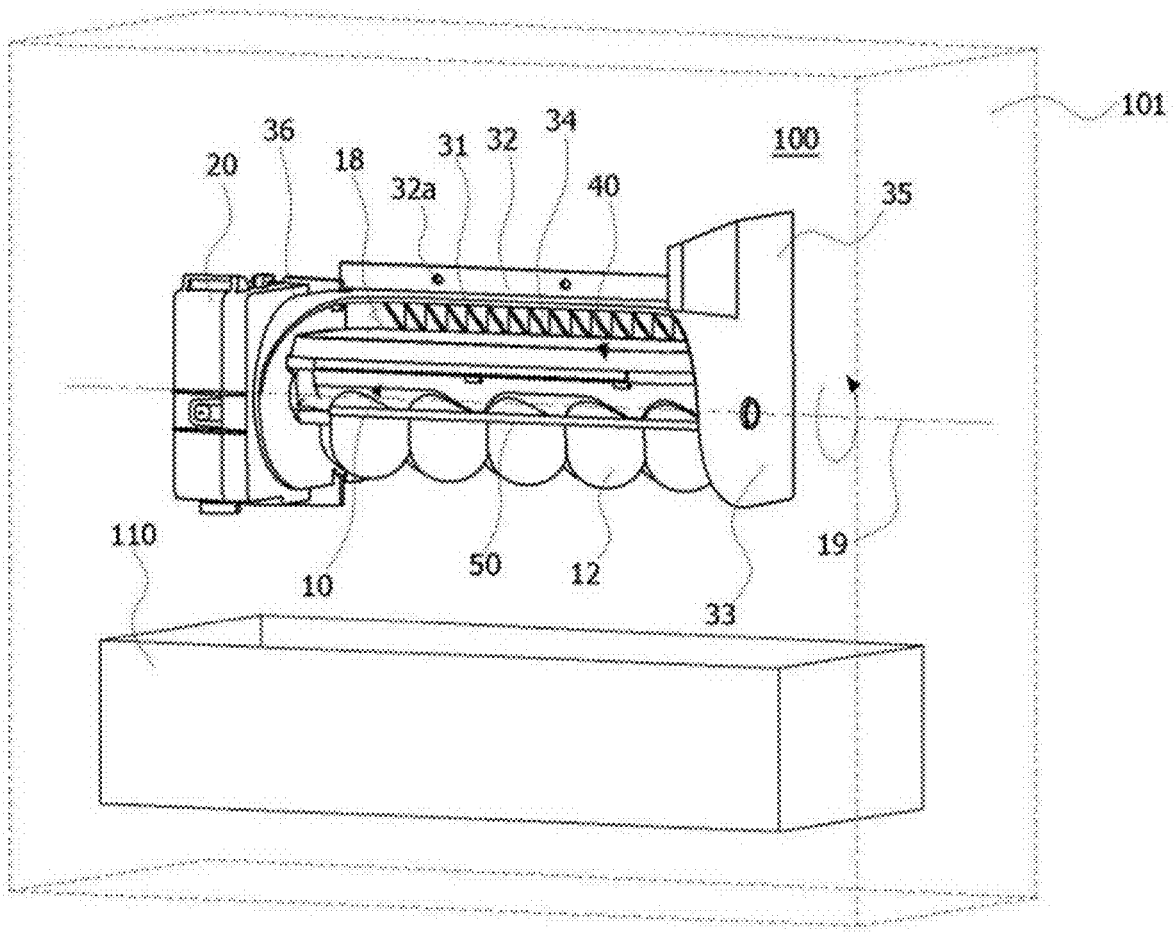
FIG. 15 is a perspective view showing an ice maker applied to the ice making room of FIG. 2.
Figure 16:
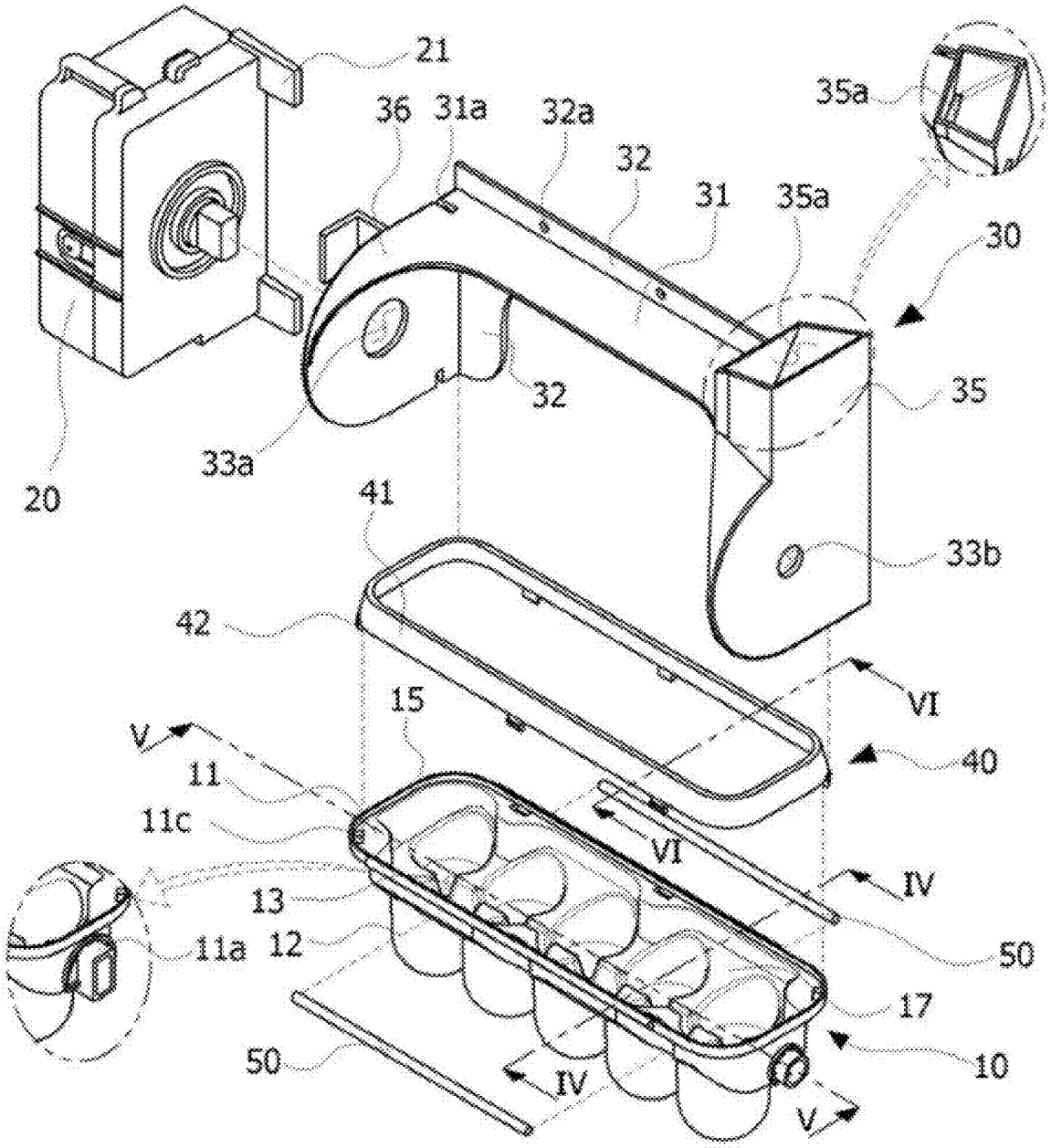
FIG. 16 is an exploded perspective view showing the ice maker of FIG. 15.

FIG. 15 is a perspective view showing an ice maker applied to the ice making room of FIG. 2, and FIG. 16 is an exploded perspective view showing the ice maker of FIG. 15.

Referring to FIGS. 15 and 16, the ice making room 101 has the ice maker 100 and the ice bucket 110 disposed therein.

The ice bucket 110 is disposed under the ice maker 100 to store the ice produced and separated from the ice maker 100. The stored ice is supplied to the dispenser 213.

The ice maker 100 includes a tray 10 and a frame part 30.

Water is supplied to tray 10 and the supplied water turns into ice. The tray 10 includes a tray body 11 and ice making parts 12. Ice making parts 12 may be referred to as ice making holders 12. Further, the tray 10 is located inside the frame assembly 30 and rotatably connected to the frame assembly 30. For example, the tray 10 has connectors 11*a* protruding outward from both side surfaces of the tray body 11. The connectors 11*a* are fittedly connected to the frame assembly 30 to allow the tray 10 to be rotatably supported against the frame assembly 30. For another example, the tray 10 has connection grooves formed on both side surfaces of the tray body 11, and connectors formed on both side surfaces of the frame assembly 30 are fitted to the connection grooves of the tray 10.

A rotation space 18 is formed between the frame assembly 30 and the tray 10. For example, a radius of rotation is formed around a rotating axis 19 formed by the connectors 11*a* of the tray 10, and the radius of rotation has a relation with depths of the ice making parts 12, that is, sizes of the ice making parts 12. The rotation space 18 enables the tray 10 to rotate gently through the rotation space 19. Further, this allows checking whether the insides of the frame assembly 30 and the tray 10 become dirty with the naked eye.

The ice making parts 12 protrude downward from the underside of the tray body 11. The number of ice making parts 12 is plural. Water is supplied to the ice making parts (ice making holders) 12 and the water turns into pieces of ice because of the cold air supplied to the ice making parts (ice making holders) 12. The shapes of the pieces of ice are determined on the inner shapes of the ice making parts (ice making holders) 12. The sectional shapes of the insides of the ice making parts (ice making holders) 12 are freely made to produce the pieces of ice having various shapes. For example, the ice making parts (ice making holders) 12 may have sectional shapes of star, square, circle, triangle, character, and the like. Further, different sectional shapes are combinedly provided to produce pieces of ice having various shapes from one tray.

The plurality of ice making parts (ice making holders) 12 are arranged inside the tray 10 in a zigzag manner. For example, if the ice making parts 12 are disposed in two rows, one row ice making parts 12 are arranged, and the other row ice making parts 12 are arranged in a misaligned manner with one row ice making parts 12, so that between the neighboring one row ice making parts 12, the other row ice making parts 12 are positioned. In this case, the tray 10 can be reduced in size, while the size of ice is being still maintained. Further, an area to which the cold air is supplied can be collectedly formed to improve an ice making efficiency.

Moving parts 13 are formed between the neighboring ice making parts 12 to connect them to each other. Through the moving parts 13, that is, the water supplied to the tray 10 is stored in any one ice making part 12 and sequentially moved to other ice making parts 12. As a result, while the flow of water supplied to the tray 10 is being induced, the amount of water stored in the ice making parts 12 is adjusted, and further, the overflow of water, which may occur when the water is freely filled in the tray 10, is prevented. More specifically, the moving parts 13 are obliquely formed between the neighboring ice making parts 12. Through the moving parts 13, the supplied water is filled into the zigzag-arranged ice making parts 12 sequentially, and if a motion or impact occurs on an object connected to the frame assembly 30, for example, if the refrigerating room door 220 is open, further, the moving parts 13 prevent the water from overflowing to the outside of the tray 10.

The tray 10 is made of a high thermal conductive composite material. An electric current is supplied to the high thermal conductive composite material, and through the heat generated from the high thermal conductive composite material, accordingly, the pieces of ice are separated from the inner surfaces of the ice making parts 12, respectively. More specifically, the bigger the ice making parts 12 become, the bigger the pieces of ice become. If the inner depths of the ice making parts 12 are increased, the pieces of ice become long. Accordingly, the ice making parts 12, which are made of the high thermal conductive composite material from which heat is emitted, apply the heat to the surfaces of the pieces of ice, so that the pieces of ice are separated from the ice making parts 12 more easily. The tray 10 rotates, and the pieces of ice separated from the ice making parts 12 fall down freely, thereby making it possible to more easily separate the pieces of ice from the ice making parts 12.

For example, the high thermal conductive composite material is made of any one polymer selected from carbon fiber, a carbon nanotube, a graphene, and a metal-containing polymer or a combination thereof. That is, the tray 10 improves thermal conductivity and emits heat therefrom through electrodes 50. The tray 10 is connected to the electrodes 50 for supplying the electric current to the high thermal conductive composite material. For example, the electrodes 50 are connected to refrigerator power lines 260.

The tray 10 to which the electric current is supplied from the electrodes 50 emits heat. The electrodes 50 are disposed at the left and right sides with respect to the ice making parts 12, while being close to the portions where ice is made. Because the heating is generated between the two electrodes 50, that is, the two electrodes 50 are located, while placing the ice making parts 12 therebetween.

Each electrode 50 includes a covered electrical wire formed of a bundle of wires. As the electrical wire is formed of the bundle of wires with relatively high flexibility, that is, the electrode 50 ensures good durability in spite of frequent rotations of the electrical wire. For example, the tray 10 is located fixedly, and if ice making on the ice maker 100 is finished, the tray 10 rotates. Next, the electric current is supplied to the electrodes 50 to allow heat to be emitted from the high thermal conductive composite material. That is, electric circuit connection is made according to the locations of the tray 10. For example, if the tray 10 rotates to its original position after the ice making of the ice maker 100 has been finished and the ice has been separated from the tray 10, the supply of the electric current stops. The supply of the electric current is controlled according to the changes in position of the tray 10, without having any additional control device, thereby making the ice maker 100 simplified in a configuration.

A tray cap 40 is connected to the tray 10. The tray cap 40 is located between the tray 10 and the frame assembly 30. The tray cap 40 includes a guard part 41 and tray connectors 42. The tray connectors 42 protrude downward from the guard part 41 in a direction toward the tray 10 and are thus fitted to fitting grooves 11*c* formed on the tray body 11 of the tray 10 to allow the tray 10 and the tray cap 40 to be connected to each other.

The guard part 41 is slantly formed toward the inside of the tray 10. The guard part 41 is adapted to induce water in the direction toward the inside of the tray 10 if a motion or impact occurs on an object connected to the frame assembly 30, for example, if the refrigerating room door 220 is open, to cause the water filled in the tray 10 to splash by inertia, and accordingly, the guard part 41 prevents the water from overflowing to the outside of the tray 10.

A motor 20 is located at the outside of the frame assembly 30 and connected to the tray 10. Between the motor 20 and the tray 10 is located the frame assembly 30. That is, the motor 20 serves to transfer power to the tray 10 rotatably connected supportedly to the frame assembly 30 and thus allows the tray 10 to rotate. For example, the motor 20 rotates the tray 10 to an angle of 90° or more. For example, the motor 20 rotates the tray 10 to an angle in the range between 100 and 180°. Through the rotation, the ice made inside the tray 10 freely falls down by gravity, and through the smooth rotation of the tray 10 even in a narrow space, it is possible to separate the ice made in the tray 10 from the tray 10.

The motor 20 is connected to the connector 11*a* formed on one side of the tray 10. The connector 11*a* of the tray 10, which is connected to the motor 20, further includes a motor connector 11*a* with a given angle. That is, while the connectors 11*a* are being circular and connected to the frame assembly 30, the motor connector 11*a* is connected to the motor 20. Accordingly, the rotary force generated from the motor 20 is more stably transferred to the tray 10.

The frame assembly 30 determines the entire shape of the ice maker 100. That is, the tray 10 and the tray cap 40 excepting the motor 20 are located inside the frame assembly 30. Accordingly, only the frame assembly 30 is connected to the refrigerating room door 220 to stably fix the ice maker 100 to the refrigerating room door 220, and as the tray 10 rotates, in the state where the ice maker 100 is stably fixed to the refrigerating room door 220, the ice made in the tray 10 is separated from the tray 10 by free falling. That is, the ice maker 100 is simple in configuration and needs only the rotation of the tray 10, thereby ensuring high durability. Further, the frame assembly 30 whose front surface is open to allow the tray 10 located therein to be checked with the naked eye. As a result, the interior of the frame assembly 30 and the normal operation of the tray 10 or the tray cap 40 can be checked with the naked eye, thereby making it easy to perform the maintenance of the ice maker 100.

The frame assembly 30 includes a frame 31, supports 33, and a guide part 35. The frame 31 extends in a longitudinal direction of the frame assembly 30, and the supports 33 are disposed on both sides of the frame 31. The frame 31 includes an attachment plate 32. The attachment plate 32 comes into contact with the refrigerating room door 220 or a position at which the ice maker 100 is located. The attachment plate 32 has a plurality of attachment holes 32*a* formed thereon to connect the ice maker 100 to the refrigerating room door 220.

Further, a plurality of ribs 34 are located between the frame 31 and the attachment plate 32. For example, the frame 31 and the attachment plate 32 are connected vertically to each other, and the plurality of triangular ribs 34 are connected between the frame 31 and the attachment plate 32. The ribs 34 are located in a direction toward the tray 10. Through the ribs 34, accordingly, the frame 31 and the attachment plate 32 are more strongly coupled to each other, and further, the ice making parts 12 can be prevented from escaping from the refrigerating room door 220 or being damaged owing to external impacts.

The supports 33 are located on both sides of the tray 10 and fittedly coupled to the tray 10. The tray 10 has the connectors 11*a* protruding therefrom toward the supports 33. Through the coupling between the connectors 11*a* and the supports 33, accordingly, the rotating axis 19 of the tray 10 is formed, and the tray 10 rotates around the rotating axis 19.

The supports 33 are semi-circularly rounded toward the front side of the frame assembly 30, that is, toward the body 210 of the refrigerator 200. Further, each support 33 has an extension portion 36 extending from the center thereof and increasing in width as it becomes close to the frame 31 of the frame assembly 30. Accordingly, the structural stiffness of the frame assembly 30 can be more improved.

The guide part 35 is located on top of the frame 31. The guide part 35 includes an inclined injection portion 35*a* formed therein. The injection portion 35*a* becomes narrow in area as it goes toward the tray 10 and is open toward the tray 10. Through the injection portion 35*a*, accordingly, the water supplied through the water supply hose 250 is induced to the tray 10, and as the water is supplied to the tray 10 in a state of being stored in the guide part 35, the water can be supplied to the tray 10 to a constant speed.

Figure 17:
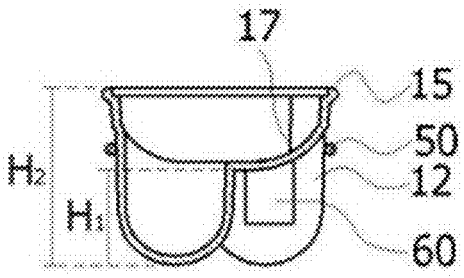
FIG. 17 is a sectional view showing a tray cut away along the line IV-IV of FIG. 15.
Figure 18:
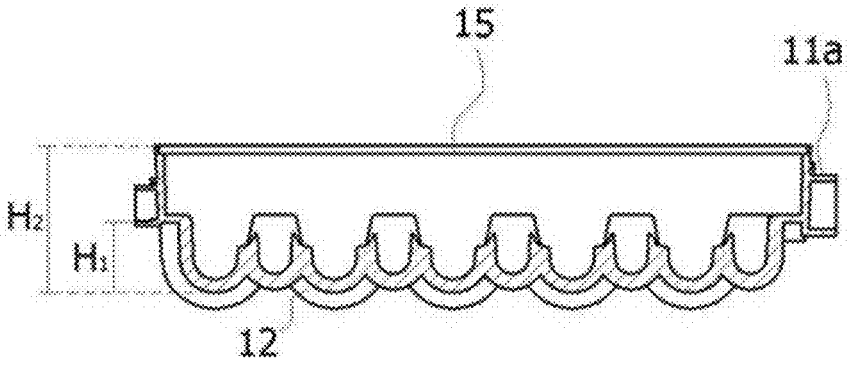
FIG. 18 is a sectional view showing the tray cut away along the line V-V of FIG. 15.

FIG. 17 is a sectional view taken along the line IV-IV of FIG. 16, and FIG. 18 is a sectional view taken along the line V-V of FIG. 16.

Referring to FIGS. 17 and 18, the tray 10 includes the tray body 11, the ice making parts 12, and tray walls 15. The connectors 11*a* protrude outward from both sides of the tray body 11. The ice making parts 12 are arranged in the tray body 11 in the zigzag manner (zigzag formation).

Further, the tray walls 15 are formed on the outer surfaces of the tray body 11. The tray walls 15 are higher than the ice making parts 12 to prevent the water filled in the tray 10 from overflowing when the refrigerating room door 220 moves or external impacts are applied to cause the water filled in the tray 10 to splash. More specifically, heights $H_2$ of the tray walls 15 are higher by 1.5 to 3 times than heights $H_1$ of the ice making parts 12. For example, if the refrigerating room door 220 is closed at a very fast speed to apply inertia to the water filled in the tray 10, the water moves along the tray walls 15 and falls down inside the tray 10 again by gravity, thereby being prevented from overflowing to the outside of the tray 10.

Further, the tray 10 includes curved surfaces 17 concavely formed from the tray walls 15 to the ice making parts 12. The curved surfaces 17 are formed in the range from the tray walls 15 to the ice making parts 12 in the direction of the inside of the tray 10. For example, the curved surfaces 17 are concavely formed. As mentioned above, when the water moves by inertia, it moves along the curved surfaces 17. In this case, the concave curved surfaces 17 increase the moving path of the water to thus decrease the moving speed of the water. Further, the curved surfaces 17 form one side surface of each ice making part 12, and if the pieces of ice are made in the ice making parts 12, accordingly, the entire stiffness of the tray 10 may be increased. For another example, the curved surfaces 17 may be convexly formed. Otherwise, the curved surfaces 17 may be concavely and convexly formed alternately. Accordingly, the moving path of the water can be more increased.

Temperature detecting sensors 60 are connected to the underside of the tray 10 or the side surface of the lower portion of the tray 10. For example, the temperature detecting sensors 60 are fitted to tray holders located at the lower portions of the ice making parts 12 of the tray 10 and thus connected to the tray 10. The temperature detecting sensors 60 serve to control the rotation of the tray 10 and the water supplied to the tray 10.

The temperature detecting sensors 60 generate signals for controlling the operation of the ice maker 100 and thus transmit the signal to a controller of the refrigerator 200. For example, the temperature detecting sensors 60 measure the temperatures at the insides of the ice making parts 12. If ice making is finished, the inner temperatures of the ice making parts 12 are below zero degree Celsius. Accordingly, it can be determined whether ice is made in the ice making parts 12. For another example, the temperature detecting sensors 60 measure temperature differences. That is, the temperature detecting sensors 60 measure a difference between a temperature when water is filled in the ice making parts 12 and a temperature when ice is made in the ice making parts 12. More specifically, as the mean temperature of the water supplied from the water supply hose 250 of the refrigerator is above zero degree Celsius, water is filled into the ice making parts 12 so that the inner temperatures of the ice making parts 12 become above zero degree Celsius. After that, if ice making is finished in the ice making parts 12, the inner temperatures of the ice making parts 12 become below zero degree Celsius. If the inner temperatures of the ice making parts 12 are 10 degrees below zero degree Celsius, a temperature difference in the ice making parts 12 is in the range between 10 and 30° C. Like this, the temperature detecting sensors 60 detect whether ice is made in the ice making parts 12 through the temperature difference.

If it is determined that the ice making is finished in the ice making parts 12, the temperature detecting sensors 60 transmit signals for separating the ice from the ice making parts 12. For example, if it is determined that the ice making is finished in the ice making parts 12, the temperature detecting sensors 60 transmit signals for transmitting electric current to the electrodes 50, so that heat is emitted from the tray 10. After that, if the ice is spaced apart from the inner surfaces of the ice making parts 12, the temperature detecting sensors 60 transmit signals for rotating the tray 10 to separate the ice from the tray 10. Further, if the insides of the ice making parts 12 are empty after the ice separation, the temperature detecting sensors 60 transmit signals for supplying water.

The temperature detecting sensors 60 are connected to the tray 10. For example, the temperature detecting sensors 60 are connected to the ice making parts 12 divided by section to detect the inside states of the ice making parts 12. More specifically, the ice making parts 12 have various shapes, and accordingly, the pieces of ice made in the ice making parts 12 are free in size. As a result, the ice making parts 12 are sorted by section, and the temperature detecting sensors 60 are disposed on the sections, respectively. Accordingly, the temperature detecting sensors 60 detect whether ice is made in the ice making parts 12 or not more accurately, thereby preventing water from pouring into the ice bucket 110 in a state where the water does not turn into ice.

The electrodes 50 are disposed on both sides of the tray body 11. For example, the electrodes 50 are located under the tray walls 15. Generally, the ice making parts 12 whose sectional areas become narrow as they are distant away from the tray 10, and accordingly, the electrodes 50 are disposed at starting positions where the ice making parts 12 whose sectional areas are biggest to melt the surfaces of the pieces of ice formed on tops of the ice making parts 12, so that the pieces of ice naturally escape from the ice making parts 12. For another example, the electrodes 50 may be located on the moving parts 13 between the neighboring ice making parts 12. In the case where the water filled in the tray 10 turns into ice, the ice is formed even on the moving parts 13 to connect the pieces of ice made in the ice making parts 12 to one another. In this case, a lump of ice may be made irrespective of the shapes of the ice making parts 12, so that the lump of ice may apply an impact to the ice bucket 110 because of its size when separated from the tray 10 and freely falls. To avoid such a problem, accordingly, the electrodes 50 are located on the moving parts 13, and the pieces of ice produced according to the shapes of the ice making parts 12 are supplied to the ice bucket 110, thereby transferring the pieces of ice to the ice bucket 110 more easily and reducing the weight and impact applied to the ice bucket 110. For yet another example, the electrodes 50 are located on the undersides of the ice making parts 12. The higher the heights $H_1$ of the ice making parts 12 are, that is, the longer the depths of the ice making parts 12 are, the longer the pieces of ice become. In this case, the longer the depths of the ice making parts 12 are, the stronger the contact forces between the ice making parts 12 and the pieces of ice become. Accordingly, while the electrodes 50 are being not seen from the outside, they are located close to the ice making parts 12. That is, the electrodes 50 are located on the undersides of the ice making parts 12 to allow heat to be generated from the portions where the contact forces between the inner surfaces of the ice making parts 12 and the pieces of ice are strong, thereby enabling the pieces of ice from escaping from the ice making parts 12 more easily.

Figure 19:
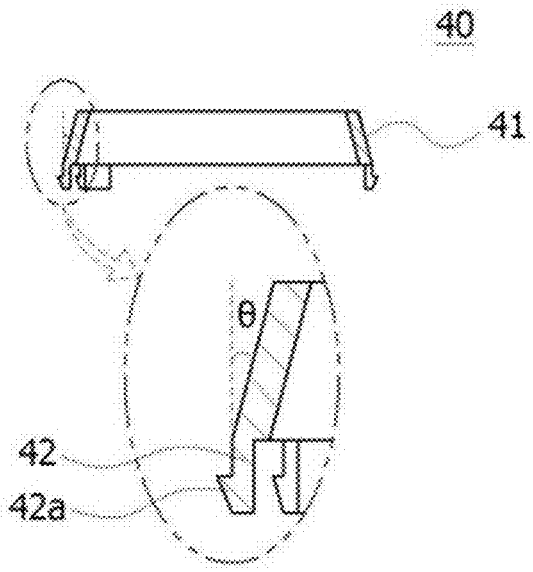
FIG. 19 is a sectional view showing a tray cap cut away along the line VI-VI of FIG. 15.

FIG. 19 is a sectional view taken along the line VI-VI of FIG. 16.

Referring to FIG. 19, the guard part 41 of the tray cap 40 is inclinedly formed in the direction toward the inside of the tray 10. In this case, the guard part 41 has an inclination θ in the range between 5 and 90°. For example, the water moving along the curved surfaces 17 of the tray 10 moves to the tray walls 15 as the moving speed thereof is decreased. In this case, the water moves along the guard part 41 inclined in the direction toward the inside of the tray 10 and then moves between the tray 10 and the tray cap 40 as if it swirls. Through the formation of the guard part 41, accordingly, even water to which a substantially high inertial force is applied can be prevented from overflowing to the outside of the ice maker 100.

The guard part 41 may be changed in shape by the transfer of the ice. For example, the guard part 41 is made of silicone. In addition to prevent water from overflowing, accordingly, the guard part 41, which is made of a soft material, does not interfere with the hard ice transferred.

The tray connectors 42 are formed in a direction from the guard part 41 to the tray 10 and have protrusions 42*a* protruding from one side thereof to be lockedly fitted to the tray 10. Accordingly, the tray 10 and the tray cap 40 can be more tightly coupled to each other.

Figure 20:
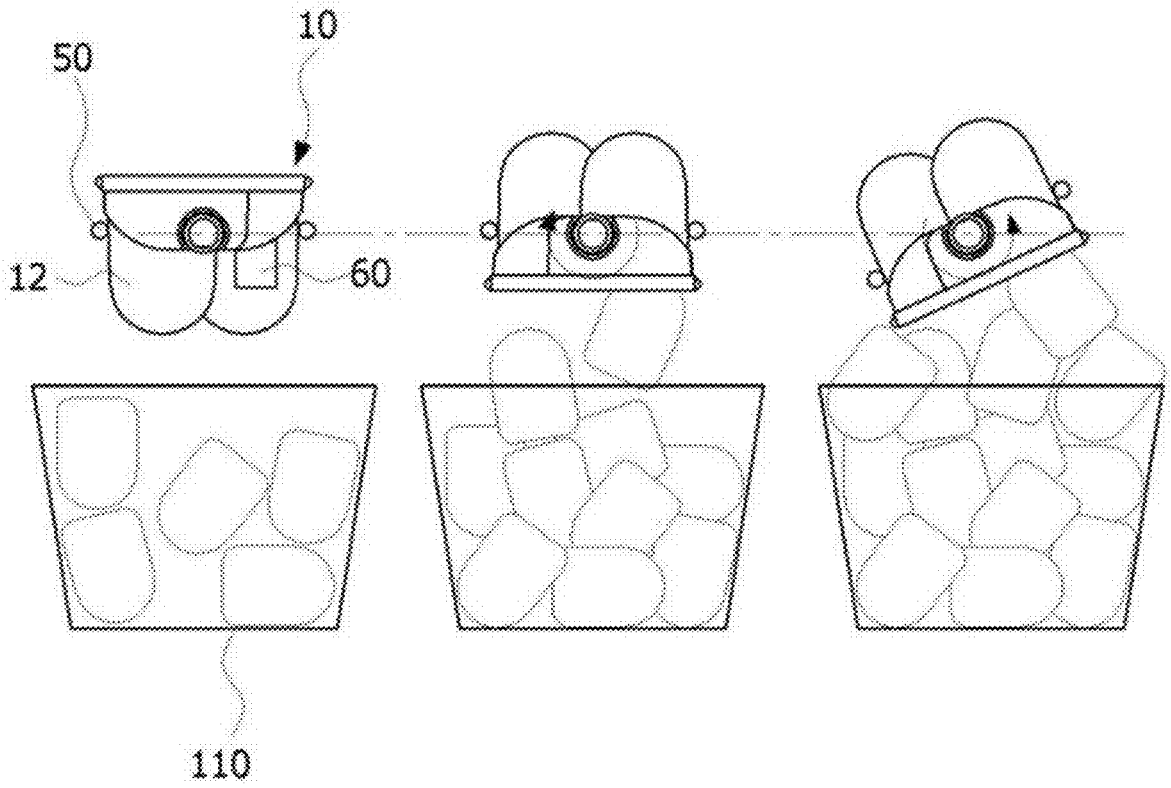
FIG. 20 is a perspective view showing an ice separation operation of the ice maker of FIG. 15.

FIG. 20 is a perspective view showing an ice separation operation of the ice maker of FIG. 15.

Referring to FIG. 20, the tray 10 of the ice maker 100 rotates around the rotating axis 19 formed by the connectors 11*a*. In this case, the ice freely falls into the ice bucket 110. Through the free falling, accordingly, there is no need for providing an additional space for an ice moving duct for moving the ice down. As a result, the ice making parts 12 of the tray 10 can be increased in size by the space made by separating the additional space, thereby allowing the tray 10 having a larger amount of ice than the trays in other ice makers that separate ice using an ejector, without any rotation.

For example, while the tray 10 rotates to move the ice to the ice bucket 110 by free falling, if the ice is full in the ice bucket 110, the tray 10 does not rotate by the ice and detects a full ice state. According to a case wherein the tray 10, to which a rotary force is transferred, does not rotate by a desired degree to apply a load to the motor 20 and a case wherein the tray 10 does not rotate to a desired degree or does not return to its original position after rotating to the desired degree, a degree of full ice is measured. More specifically, if the tray 10 does not twist by a desired angle upon ice separation, the tray 10 returns to its original position and stops ice making. Further, if the tray 10 is locked onto the ice and does not return to its original position after the ice separation through its rotation, the tray 10 recognizes the full ice state and stops ice making. After that, if the ice is used, the height of ice accumulated in the ice bucket 110 is reduced, and accordingly, the tray 10 tries to return to its original position by periodic operation of the motor 20.

More specifically, if it is defined that the rotation of 180° of the tray 10 is a forward rotation with respect to the normal state (0°) of the tray 10, a rotation in a direction from a position of 180° to a position of 0° is a reverse rotation. Further, the time required from the position of 0° to the position of 180° or from the position of 180° to the position of 0° is called set time.

For example, in the case where it is determined that the ice making in the ice making parts 12 is finished through the temperature detection sensors 60, if electricity is applied to the motor 20, the tray 10 performs the forward rotation of 180°, and if the tray 10 reaches the position of 180° within the set time, the electric current is increased. In this case, the tray 10 stops, and the electricity is applied to the ice maker 100 during given time to heat the tray 10, so that the ice making parts 12 are heated to melt the pieces of ice made therein to allow the pieces of ice to freely fall down. If the temperature of the tray 10 is increased, the supply of electric current to the tray 10 is stopped to thus rotate the tray 10 reversely through the motor 20. In this case, if a load is increased before the set time needed for the rotation, it is determined that the tray 10 is locked onto the ice because of full ice, and next, the supply of water to the ice maker 100 is stopped to allow the tray 10 to rotate forwardly again to the position of 180°. The reverse rotation is periodically tried, and if the tray 10 reaches the position of 0° within the set time to thus increase the load, the full ice state is released, so that water is supplied again to the ice maker 100 to perform ice making.

For another example, in the case where it is determined that the ice making in the ice making parts 12 is finished through the temperature detection sensors 60, if electricity is applied to the motor 20, the tray 10 rotates forwardly to increase a load current within the time shorter than the set time, full ice is determined.

In this case, the tray 10 rotates reversely and reaches the position of 0°. If the tray 10 periodically rotates forwardly to increase the load within the set time, the tray 10 reaches the position of 180°, and in this case, electricity is applied to the tray 10 to heat the tray 10, so that ice separation is performed. After the ice separation, if the tray 10 twists reversely to increase the load within the set time, water is continuously supplied to perform ice making. If the load is increased before the set time during the reverse rotation at the position of 180°, full ice is determined, and in this case, the tray 10 rotates forwardly again to reach the position of 180° and stops. The tray 10 periodically tries to rotate reversely, and if the tray 10 reaches the position of 0° within the set time to increase the load, the full ice state is released, so that water is supplied again to the ice maker 100 to perform ice making.

That is, the ice maker 100 detects ice separation and full ice through the principle of the rotation of the motor 20, not through a mechanism or optical sensor for detecting full ice.

Further, the ice maker 100 detects the full ice more reliably through the entire tray 10 mechanically rotating, than that through a shut-off arm, ball wire, or an optical sensor that just detect the full ice on portions thereof. That is, if the full ice is detected through the rotation of the tray 10 itself, the entire three-dimensional space of the ice maker 100 is sensed, thereby removing detection errors, and without any additional sensor, further, a control logic can be made only with the load of the motor. In the existing full ice detection method wherein a gear structure is additionally provided to an ice separation motor to perform line detection for a portion to which ice falls in a longitudinal direction by a full ice detection sensor or optical sensor that moves or rotates vertically with respect to a direction along which ice moves down, however, the entire top of the ice bucket 110 cannot be sensed, so that the ice is accumulated on the space not sensed and thus overloaded on the ice bucket 110.

As described above, the refrigerator according to exemplary embodiments of the invention is configured to have the ice maker capable of supplying a sufficiently large amount of ice, while locating the convenience space utilizable on the main doors.

What is claimed is:

1. A refrigerator comprising:

at least one main door for a storage room of the refrigerator, the at least one main door having at least one convenience space and a dispenser;

at least one sub-door for the at least one convenience space, the at least one sub-door connected to the at least one main door;

an ice making room connected to the at least one main door to supply water or ice to the dispenser;

a cold air duct connecting an evaporator to a cold air supply part so that cold air is introduced from the evaporator to the cold air supply part;

a cold air fan disposed adjacent to the evaporator and configured to introduce the cold air into the cold air duct; and a corrugated bellows tube connecting the cold air duct and the ice making room to enable cold air supply and emission, the corrugated bellows tube being configured to be elongated when the at least one main door is opened and compressed when the at least one main door is closed, wherein a portion of the corrugated bellows tube is inserted into the ice making room and coupled to an inner wall of the ice making room when the at least one main door is closed, wherein the at least one convenience space disposed on the at least one main door includes a first cold air portion for supplying cold air thereinto from the ice making room, and a second cold air portion for emitting the cold air of the at least one convenience space to the storage room, and wherein the ice making room includes an ice maker for producing ice, a cold air supply part for supplying the cold air to the ice maker, an ice bucket maintained at a temperature below zero degrees Celsius by passing the cold air through the ice maker, and a cold air emission part for emitting the cold air of the ice bucket to the storage room.

2. The refrigerator according to claim 1, wherein the at least one convenience space is positioned at the top of the dispenser.

3. The refrigerator according to claim 1, wherein the at least one sub-door comprises an opening for exposing the dispenser to an outside.

4. The refrigerator according to claim 1, wherein the storage room comprises:

a refrigerating room to which the at least one main door is connected; and a freezing room disposed below the refrigerating room to supply the cold air to the at least one main door.

5. The refrigerator according to claim 4, further comprising:

cold air passages disposed adjacent to one side of the at least one main door and connected to the at least one main door to allow the freezing room to communicate with the refrigerating room; and a blowing fan disposed in the freezing room to supply the cold air of the freezing room to the corresponding cold air passage.

6. The refrigerator according to claim 5, wherein the at least one main door comprises circulating ducts connected to the cold air passages to supply and emit the cold air of the freezing room to and from the ice making room.

7. The refrigerator according to claim 5, wherein the cold air passages are disposed at a bottom surface of the refrigerating room.

8. The refrigerator according to claim 5, wherein the cold air passages are disposed at a side surface of the refrigerating room.

9. The refrigerator according to claim 1, wherein the ice making room comprises an insulation layer connected to the at least one convenience space.

10. The refrigerator according to claim 1, wherein a portion of the cold air duct is exposed to the storage room.

11. The refrigerator according to claim 1, wherein the cold air duct includes a cold air duct end portion extending therefrom to be exposed to one side of the evaporator.

12. The refrigerator according to claim 11, wherein the cold air fan is disposed in an interior of the cold air duct end portion.

* * * * *